US006682189B2

(12) United States Patent
May et al.

(10) Patent No.: US 6,682,189 B2
(45) Date of Patent: Jan. 27, 2004

(54) INK JET IMAGING VIA COAGULATION ON AN INTERMEDIATE MEMBER

(75) Inventors: John Walter May, Rochester, NY (US); Arun Chowdry, Pittsford, NY (US); Thomas Nathaniel Tombs, Brockport, NY (US)

(73) Assignee: NexPress Solutions LLC, Rochester, NY (US)

( * ) Notice: Subject to any disclaimer, the term of this patent is extended or adjusted under 35 U.S.C. 154(b) by 155 days.

(21) Appl. No.: 09/973,244

(22) Filed: Oct. 9, 2001

(65) Prior Publication Data

US 2003/0067529 A1 Apr. 10, 2003

(51) Int. Cl.[7] ..... B41J 2/01
(52) U.S. Cl. ..... 347/103
(58) Field of Search ..... 347/95, 100, 101–103

(56) References Cited

U.S. PATENT DOCUMENTS 5,365,261 A * 11/1994 Ozawa et al. ..... 347/103
5,805,191 A * 9/1998 Jones et al. ..... 347/103
5,841,456 A * 11/1998 Takei et al. ..... 347/103
6,196,674 B1 * 3/2001 Takemoto ..... 347/103

* cited by examiner

*Primary Examiner*—Stephen D. Meier
*Assistant Examiner*—An H. Do
(74) *Attorney, Agent, or Firm*—Lawrence P. Kessler

(57) ABSTRACT

Apparatus and method of making an ink-jet-ink-derived material image on a receiver. An ink jet device is used to form a coagulable ink image on an intermediate member. Coagulates within the coagulable ink image are formed, and excess liquid is removed from the coagulates so as to form an ink-jet-ink-derived material image. The ink-jet-ink-derived image from the operational surface of the intermediate member is transferred to another member, which another member may be a receiver member, a drum or a web.

55 Claims, 10 Drawing Sheets

2a
2b
1a
1b
INK DROPLETS DEPOSITED 4
3
COAGULATES FORMED

5
EXCESS LIQUID REMOVED

INK JET IMAGING VIA COAGULATION ON AN INTERMEDIATE MEMBER

CROSS-REFERENCE TO RELATED APPLICATIONS

Reference is made to the following commonly-assigned copending applications:

U.S. patent application Ser. No. 09/973,239, entitled INK JET PROCESS INCLUDING REMOVAL OF EXCESS LIQUID FROM AN INTERMEDIATE MEMBER by Thomas N. Tombs, et al, (Docket 81,459/LPK), and U.S. patent application Ser. No. 09/973,228, entitled IMAGING USING A COAGULABLE INK ON AN INTERMEDIATE MEMBER by John W. May, et al (Docket 81,461/LPK), concurrently filed herewith, the disclosures of which are incorporated herein.

FIELD OF THE INVENTION

The invention relates in general to digital image recording and printing in an apparatus including an ink jet device for forming an ink image on a member. In particular, a coagulable ink is used in the ink jet device, coagulates are formed in the ink image on the member, excess liquid is removed from the coagulates while the coagulates remain on the member, and the coagulates are subsequently transferred to a receiver.

BACKGROUND OF THE INVENTION

High resolution digital input imaging processes are desirable for superior quality printing applications, especially high quality color printing applications. As is well known, such processes may include electrostatographic processes using small-particle dry toners, e.g., having particle diameters less than about 7 micrometers, electrostatographic processes using nonaqueous liquid developers (also known as liquid toners) in which particle size is typically of the order of 0.1 micrometer or less, and ink jet processes using aqueous-based or nonaqueous inks. The less commonly used nonaqueous ink jet technology has an advantage over aqueous-based ink jet technology in that an image formed on a receiver requires relatively little drying energy and therefore dries relatively rapidly.

The most widely used high resolution digital commercial electrostatographic processes involve electrophotography. Although capable of high process speeds and excellent quality printing, electrophotographic processes utilizing dry or liquid toners are inherently complicated, and require expensive, bulky and complex equipment. Moreover, due to their complex nature, electrophotographic processes and electrophotographic machines tend to require significant maintenance.

Digital ink jet processes have the inherent potential to be simpler, less costly, and more reliable than digital electrophotographic processes. Generally, it is usual for ink to be fed through a nozzle, the diameter of which nozzle being a major factor in determining the droplet size and hence the image resolution on a recording surface. There are two major classes of ink jet printing, namely, continuous ink jet printing and drop-on-demand ink jet printing. Continuous printing utilizes the nozzle to produce a continuous stream of electrically charged droplets, some of which droplets are selectively delivered to the recording surface, the remainder being electrostatically deflected and collected in a sump for reuse. Drop-on-demand ink jet printing produces drops from a small nozzle only as required to generate an image, the drops being produced and ejected from the nozzle by local pressure or temperature changes in the liquid in the immediate vicinity of the nozzle, e.g., using a piezoelectric device, an acoustic device or a thermal process controlled in accordance with digital data signals. In order to produce a gray scale image, variable numbers of drops are delivered to each imaging pixel. Typically, an ink jet head of an ink jet device includes a plurality of nozzles. In most commercial ink jet systems, aqueous-based inks containing dye colorants in relatively low concentrations are used. As a result, high image densities are difficult to achieve, image drying is not trivial, and images are not archival because many dyes are disadvantageously subject to fading. Moreover, the quality of an aqueous-based ink jet image is strongly dependent upon the properties of the recording surface, and will for example be quite different on a porous paper surface than on a smooth plastic receiver surface. By contrast, the quality of an electrophotographic toner image is relatively insensitive to the recording surface, and the toner colorants in both dry and liquid electrophotographic developers are generally finely divided or comminuted pigments that are stable against fading and able to give high image densities.

To overcome problems associated with fading and low image densities associated with dyed aqueous-based inks, pigmented aqueous-based inks have been disclosed in which a pigmented material is colloidally dispersed. Typically, a relatively high concentration of pigmented material is required to produce the desired highest image densities (Dmax). Exemplary art pertaining to pigmented aqueous-based inks includes the recently issued Lin et al. patent (U.S. Pat. No. 6,143,807) and the Erdtmann et al. patent (U.S. Pat. No. 6,153,000). Generally, pigmented inks have a much greater propensity to clog or modify the opening jet(s) of a drop-on-demand type of ink jet head than do dyed inks, especially for the narrow diameter jets required for high resolution drop-on-demand ink jet imaging, e.g., at 600 dots per inch. Drop-on-demand printers do not have a continuous high pressure in the nozzle, and modification of the nozzle behavior by deposition of pigment particles is strongly dependent on local conditions in the nozzle. In continuous ink jet printers using pigmented inks, the relatively high concentrations of pigment typically affects the droplet breakup which tends to result in nonuniform printing.

Pigmented nonaqueous inks having particle sizes smaller than 0.1 micrometer for use in ink jet apparatus are disclosed in the Romano et al. patent (U.S. Pat. No. 6,053,438), and the Santilli et al. patent (U.S. Pat. No. 6,166,105).

Long term stability (good shelf life) is an important property of both aqueous-based and nonaqueous colloidal dispersions useful for commercial ink jet inks. The principles of stabilization and destabilization are well documented for aqueous-based and nonaqueous colloids, such as for example in articles by B. J. Carroll in *Surface and Colloid Science*, Volume 9, pp 1–68, (Wiley, 1976), by J. Th. G. Overbeek in *Colloidal Dispersions*, Special Publication No. 43, pp 1–22, (The Royal Society of Chemistry, 1982), and D. H. Napper, ibid., pp 99–128, and in the book by D. H. Everett, *Basic Principles of Colloid Science*, (The Royal Society of Chemistry, 1988). To prevent attractive dispersion forces (or Van der Waals forces) from producing flocculation and coagulation of colloidally dispersed particles, aqueous-based dispersions are typically electrostatically stabilized by electrostatic repulsions between the electrical double layers surrounding charged colloidal particles, and nonaqueous dispersions are typically sterically stabilized. A degree of steric stabilization can be important for certain aqueous-based colloids which are primarily electrostatically stabilized. Similarly, a degree of electrostatic stabilization can be important for certain nonaqueous colloids which are primarily sterically stabilized, such as for example a typical electrographic liquid developer. As described in the references cited above in this paragraph, electrostatically stabilized liquid dispersions may be destabilized by the addition of ionic salts, by changing the pH, by application of an electric field, and by heating or cooling. Sterically stabilized liquid dispersions may be destabilized by heating or cooling, by application of an electric field, by adding a non-solvent for the solution-embedded ends of sterically stabilizing polymeric moieties adsorbed to the colloid particle surfaces (i.e., adding a non θ-solvent), or by adding an excess of stabilizing polymer. It is accepted usage to refer to flocs as precursors to coagulates, the flocs generally being loosely or reversibly bound, and the coagulates irreversibly bound. Hereinbelow, both flocs and coagulates may be referred to as aggregates or agglomerates.

A deficiency associated with most high resolution conventional ink jet devices that deposit ink directly on to a (porous) paper receiver sheet is an unavoidable tendency for image spreading, with a concomitant resulting degradation of resolution and sharpness of the image produced. As a drop of deposited liquid ink is absorbed, capillary forces tend to draw the ink along the surface and into the microchannels between paper fibers, thereby causing a loss of resolution. Inasmuch as the colorant concentration of a dyed aqueous-based ink tends to be low, there is a comparatively large proportion of liquid vehicle which must be absorbed from each drop. This also holds true for the case of pigmented aqueous-based inks, for which particle sizes may be submicron, i.e., such very small particles can be swept along by the carrier liquid as it spreads in the paper, thereby compromising high resolution imaging quality. In addition to capillary spreading by liquid absorption in a receiver, spreading may also be a problem if the carrier liquid is not readily absorbed by a receiver, e.g., if the receiver is a coated specialty paper used in a high resolution conventional ink jet device that deposits ink directly on to a receiver. The spreading is strongly dependent upon the surface energies of the coating on the paper and of the ink. Unusual particle size distributions such as disclosed in the above-cited Lin et al. patent (U.S. Pat. No. 6,143,807) may be useful with pigmented aqueous-based inks, perhaps to mitigate the effects of image spread.

A way to control image spread of an ink jet image is to cause a precipitation, coagulation, agglomeration or aggregation of an ink jet ink colorant near the surface of a porous receiver. In particular, such a technique is useful for aqueous-based dyed ink jet inks. The Tsuchii et al. patent (U.S. Pat. No. 5,805,190) discloses types and amounts of a "print property improving liquid" ejected by a jetting device on to a location on receiver prior to a colorant ink jetted to the same location. The Shioya et al. patent (U.S. Pat. No. 5,864,350) discloses depositing a liquid for coagulating a dye contained in a colored ink jet ink after a previous colored ink jet ink has been deposited on a receiver. The Yatake patent (U.S. Pat. No. 6,004,389) discloses an ink jet ink composition such that a "reaction solution, containing a reactant, capable of breaking the state of dispersion and/or dissolution of a pigment in the ink composition is brought into contact with the ink composition". The reaction solution may be deposited on a receiver before or after the ink jet ink, either over the entire surface of the receiver or selected portions, e.g., using a jetting device. The reagent solution may include cationic compounds such as inorganic metal salts, primary, secondary and tertiary amines, ammonium and phosphonium compounds. The Inui et al. patent (U.S. Pat. No. 6,062,674) discloses the use of a coagulating liquid to enhance the black image portion of an ink jet image on a receiver. The Shioya patent (U.S. Pat. No. 6,084,621) teaches jetting an "invisible" latent image on to a receiver, which latent image includes a coagulating agent or chemical, the latent image being developable by a coagulable ink jet ink deposited on the same pixels as the latent image. The Kasamatsu et al. patent (U.S. Pat. No. 6,062,674) discloses use of a "treatment liquid" for aggregating the dye in an ink jet ink on a receiver to prevent penetration of the dyestuff into a receiver, thereby making the image water resistant and improving fade resistance. The Fujita et al. patent (U.S. Pat. No. 6,099,116) discloses that the amount of a "processing liquid" can be adjusted for each imaging pixel independently to provide an ink jet image on a receiver with sufficient water resistance. The Kato et al. patent (U.S. Pat. No. 6,102,537) discloses a "printing property improving liquid" for creating an improved multicolor ink jet image on a receiver, which "printing property improving liquid" may be applied to selected imaging pixels before, between, or after the jetting of each color ink jet ink. The Tajika et al. patent (U.S. Pat. No. 6,120,141) discloses partial overlapping of places on a receiver where ink jet ink and a "printability improving liquid" are deposited. The Inui et al. patent (U.S. Pat. No. 6,123,411) describes the deposition of a "recording-improvement liquid" on pixels at boundaries around groups of imaging pixels to prevent spreading or "feathering" of an ink jet image on a receiver. The Suzuki et al. patent (U.S. Pat. No. 6,153,001) describes a "fixing agent" which may include divalent and trivalent inorganic cations, which "fixing agent" is applied to a receiver before or after the arrival of an ink jet ink image on the receiver. The Oikawa patent (U.S. Pat. No. 6,164,773) discloses the ejection of a coagulating "printing improvement liquid" on to a receiver before or after deposition of an ink jet image on the receiver, the apparatus preventing the "printing improvement liquid" from splashing back from the receiver to the ink jet head to cause a clogging of the jets.

An intermediate element or member may be used with an ink jet device in which device one or more colored inks may be deposited via ink jet on to the surface of the intermediate member and subsequently co-transferred to a receiver such as a paper sheet. It is worthy of note that in none of the ink jet imaging patents cited above in the previous paragraph is a coagulation process or reagent used to produce a coagulated image on an intermediate member. In the Anderson patent (U.S. Pat. No. 5,099,256) an intermediate member having a thermally conductive silicone surface that is rough to prevent image spreading is heated to dehydrate an aqueous-based ink jet image formed thereon prior to transfer of the ink jet image to a receiver. The Okamato et al. patent (U.S. Pat. No. 5,598,195) discloses an ink jet recording method, in which a voltage pulse applied to an electrode in an ink jet recording head and an opposing electrode disposed on the opposite side of an intermediate recording material produces a Coulomb force that causes an ink to be jetted on to the intermediate recording material. The Xu patent (U.S. Pat. No. 5,746,816) discloses an aqueous-based liquid ink containing an insoluble dye. Such an ink containing an insoluble dye is used in the Hale et al. patent (U.S. Pat. No. 5,830,263) which discloses a method in which a liquid ink containing a heat activated dye is imagewise deposited via an ink jet device on an intermediate member, which dye being subsequently released and thereby transferred to a receiver sheet by combined heat and pressure. The Hirata et al. patent (U.S. Pat. No. 5,949,464) describes an ink jet ink curable by ultraviolet light for use in conjunction with an intermediate member. The Koike et al. patent (U.S. Pat. No. 5,988,790) discloses an aqueous-based-based ink jet ink for use with an intermediate member in a printer. The Komatsu et al. patent (U.S. Pat. No. 6,059,407) describes the use of a surfactant applied to the surface of an intermediate member employed in an ink jet recording method. The Jeanmaire et al. patent (U.S. Pat. No. 6,109,746) discloses a method of use of an intermediate member in an ink jet machine, which intermediate member includes cells where aqueous-based ink jet drops are mixed to provide a desired color in each cell, the mixed inks subsequently transferred to an image receiver. The Suzuki et al. patent (U.S. Pat. No. 6,153,001) cited in the previous paragraph discloses a pigmented ink including water and an aqueous organic solvent, which ink may be used with an intermediate member in an ink jet recording method.

Ink jet processes employing an intermediate member can use so-called phase change inks. The Titterington et al. patent (U.S. Pat. No. 5,372,852) describes a molten ink which solidifies on contact with a liquid layer on the surface of an intermediate member. Similarly, the Bui et al. patent (U.S. Pat. No. 5,389,958) describes a phase change ink deposited on a sacrificial liquid layer on an intermediate member. The Jones patent (U.S. Pat. No. 5,864,774) discloses a melted ink jetted to an intermediate member. The Urban et al. patent (U.S. Pat. No. 5,974,298) discloses a duplex ink jet apparatus employing phase change ink jet ink on an intermediate transfer surface. The Ochi et al. patent (U.S. Pat. No. 6,102,538) describes a phase change ink jet ink which undergoes a viscosity change when ink droplets arrive at the surface of an intermediate member. The Burr et al. patent (U.S. Pat. No. 6,113,231) describe an offset ink jet color printing method in which hot melt ink droplets harden after deposition on an intermediate member, such that different color inks are overlaid on the intermediate member and subsequently co-transferred to a final receiving medium.

A novel type of electrographic apparatus for depositing drops of nonaqueous liquid inks containing pigmented particles is disclosed in the Newcombe et al. patent (U.S. Pat. No. 5,992,756), the Taylor et al. patent (U.S. Pat. No. 6,019,455), the Lima-Marques patent (European Patent No. 0646044), the Emerton et al. patent (European Patent No. 0760746), the Newcombe et al. patents (European Patent Nos. 0885126 and 0885128), the Janse van Rensburg patent (European Patent No. 0885129), the Mace et al. patent (European Patent No. 0958141), and the Newcombe patent (European Patent No. 0973643). The nonaqueous liquid inks that are used include electrically charged pigmented particles and oppositely charged inverse micelle counterions. Ink is supplied to a writing head wherein the electroscopic pigmented particles are concentrated near an ejection location. By applying controlled voltage pulses, agglomerates or clusters of the pigmented particles are electrostatically ejected from the ejection location and travel to the surface of a receiver member. As a result of agglomeration, relatively little liquid is carried to the receiver, requiring little or no drying or removal of excess liquid from the receiver. Although a physical understanding of how the particles are concentrated has not yet been elucidated in detail, the concentrating of the pigmented particles near the ejection location (accompanied by at least a partial separation from counterions) is attributed to electrophoretic and dielectrophoretic forces. These electrophoretic and dielectrophoretic forces are induced by a number of important factors which may not as yet be optimized, including a suitable geometrical arrangement of electrodes in the writing head, suitable potentials applied to the electrodes, a suitable geometry of the ejection location, and a suitable geometry of the liquid flow channels within the head. This type of novel apparatus tends to have an inherent problem with plateout of particles, at or near the ejection location, thereby deleteriously affecting performance. There is also a problem with replenishment of non-agglomerated ink in the vicinity of a nozzle and removal of the particle-depleted carrier liquid from the vicinity of the nozzle. Another difficulty is a need for a complex writing head including a number of properly disposed electrodes and associated applied potentials. Such apparatus also has a disadvantage by comparison with conventional liquid developer electrophotography in that the associated ink technology is relatively immature. For example, specially tailored inks are needed to provide suitable agglomeration behavior in the write head. Such inks are reported to need high resistivities, higher than the resistivity of a typical electrophotographic liquid developer. Moreover, the inks require a suitable stability or keeping property for practical utility in the marketplace. Long keeping or storage time is a characteristic that was historically difficult to achieve for commercial electrophotographic liquid developers. Nonaqueous liquid inks suitable for use with a writing head of an apparatus of the above disclosures are described in the Nicholls et al. patent (U.S. Pat. No. 5,453,121) and the Nicholls patents (U.S. Pat. No. 6,117,225 and European Patent No. 0939794). Similar apparatus and types of inks are disclosed in the Kohyama patent (U.S. Pat. No. 6,126,274) for image recording, and the Kato patent (U.S. Pat. No. 6,133,341) for making lithographic printing plates. The Nicholls patent (U.S. Pat. No. 6,117,225) cited above discloses an improved ink which reduces plateout, the improved ink including marking particles covered with a highly resistive coating.

The aforementioned Kato patent (U.S. Pat. No. 6,133,341) describes the use of a head for ink jet recording including a narrow electrode mounted in a slit, such that droplets of nonaqueous ink are discharged from the discharge slit upon application of a voltage to the discharge electrode; this patent does not explicitly mention a concentrating of the pigmented particles before droplets are discharged from the head.

The above-cited Kohyama patent (U.S. Pat. No. 6,126,274) discloses the use of an intermediate image receiving member for receiving agglomerated marking particles ejected from the writing head. This intermediate image receiving member is a moving web, and a particulate image formed on this web by the writing head is transported by the web to a transfer nip where the particulate image is transferred to a receiver member. Transfer of the marking particles to the receiver may be effected thermally or electrostatically.

The use of a preferably compliant intermediate transfer member in liquid developer electrophotography is well known, e.g., see recent patents including the Gazit et al. patent (U.S. Pat. No. 5,745,829), the Fujiwara et al. patent (U.S. Pat. No. 5,745,830), the Tarnawskyj et al. patent (U.S. Pat. No. 5,761,595), the Hara et al. patent (U.S. Pat. No. 6,097,920), the Nakano et al. patent (U.S. Pat. No. 6,115,576), and the Miyamoto et al. patent (U.S. Pat. No. 6,146,804). An intermediate transfer member is of particular utility for successively receiving, from one or more photoconductive imaging members, a plurality of single color liquid developer toner images transferred in register with one another to form a plural toner image on the intermediate member, the plural or full color toner image being subsequently transferred from the intermediate member to a receiver member.

As is well known, most electrophotographic liquid developers include only a small percentage by weight of toner solids. Typically, less than about 5% by weight of a liquid developer is toner, the remainder being a carrier liquid or dispersant in which the toner particles are dispersed. The toner particles generally have diameters less than about 3 micrometers, typically 1 micrometer or less. Inasmuch as a toner particle image immediately after transfer to a receiver sheet preferably contains a minimum amount of liquid, various methods have been disclosed to remove excess carrier liquid or developer from a wet electrographic liquid toner image, the wet toner image being located on an imaging member or on an intermediate transfer member prior to removal of excess liquid.

The Landa et al. patent (U.S. Pat. No. 4,286,039) describes removal of excess developer from a photoconductor using a deformable squeegee roller biased to a voltage having a polarity of the same sign as that of the toner particles. The Moraw patent (U.S. Pat. No. 4,482,242) describes removal of excess developer from a photoconductive drum using a stripper roller rotating 20% faster than the drum. The Moe et al. patent (U.S. Pat. No. 5,754,928) and the Teschendorf et al. patents (U.S. Pat. Nos. 5,713,068, 5,781,834 and 5,805,963) describe removal of excess developer liquid using a squeegee roller. The Tagansky et al. patent (U.S. Pat. No. 5,854,960) describe removal of excess liquid from a surface, leaving a portion of the liquid for transfer to another surface. The Kellie et al. patent (U.S. Pat. No. 6,091,918) describes removal of excess developer liquid using a squeegee roller having a core with a crowned profile.

The Asada et al. patent (U.S. Pat. No. 5,765,084) describes use of squeeze rollers to remove excess developer liquid from a photoconductive member and to control the thickness of the developer liquid prior to toner transfer from the photoconductive member to an intermediate member. A full color imaging apparatus is described in which a corona charge having a polarity the same as the polarity of the charge on the toner particles is applied to a first color toner image after transfer of the first color image to the intermediate member. A similar corona charging procedure is followed after a second color toner image has been transferred in registry on top of the first color toner image, and the process repeated until a full color toner image is on the intermediate member for subsequent transfer to a receiver sheet. The corona chargings after each transfer to the intermediate member levels the surface potential and also retards back transfer of toner to the imaging member.

In the Landa et al. patent (U.S. Pat. No. 4,974,027) an apparatus for "rigidizing" a liquid developed toner image on an image bearing surface prior to transfer is described, including using a squeegee device such as a metering roller to remove excess liquid and applying an electric field between the image bearing surface and another member, e.g., a roller in close propinquity to the image bearing surface. In the Domoto et al. patent (U.S. Pat. No. 5,974,292) an apparatus including liquid development is described for metering post-development fluid laid down on an imaging belt after development of a latent image, wherein a compacting of a toner image on the imaging belt is accomplished by the application of an electric field in a direction to urge the toner particles towards the surface of the imaging belt.

In the Simms et al. patent (U.S. Pat. No. 5,332,642) a device and method are disclosed for increasing the solids content of a liquid-developed image on an absorptive image carrying member such as a primary imaging member or an intermediate transfer member. The image carrying member may be a porous roller provided with an interior vacuum mechanism for drawing carrier fluid through the absorptive material of the roller, the roller also being electrified with a polarity to repel toner particles from the absorptive or porous material so that minimal toner particles are transferred to the absorptive material. In the Moser patent (U.S. Pat. No. 5,723,251) an intermediate transfer member roller is disclosed for liquid development electrophotography which includes an absorptive layer for imbibing carrier liquid from a toner image on the intermediate transfer roller. A contact member may be used for squeezing the imbibed liquid from the intermediate transfer roller. Alternatively, a vacuum may be used for sucking the imbibed liquid from the absorptive layer, or a heating or cooling member may be used for "sweating" liquid from the absorptive layer. In the Herman et al. patent (U.S. Pat. No. 5,965,314) an intermediate transfer member is described that contains a material which is capable of absorbing carrier liquid in amounts from 5% to 100% by weight, based on the weight of the absorbing material, after ten minutes of soaking. Suitable absorbing materials are elastomeric materials having an affinity for hydrocarbon carrier liquids, such as crosslinked isoprene, natural rubber, EPDM rubber and certain crosslinked silicone elastomers.

The Landa et al. patent (U.S. Pat. No. 4,286,039) previously cited herein above discloses the use of a blotting roller to absorb excess developer liquid from a photoconductor. The blotting roller is biased by a potential having a sign the same as a sign of the toner particles in the developer, and includes a closed-cell polyurethane foam formed with open surface pores. Devices are provided for squeezing liquid absorbed by the pores from the pores so as to continuously present open dry pores for blotting. The Landa patent (U.S. Pat. No. 4,392,742) similarly describes a blotting roller having externally exposed internally isolated surface cells. The Kurotori et al. patent (U.S. Pat. No. 4,985,733) discloses a blotting roller, a transfer sheet including a liquid developed image facing the blotting roller, and a backup roller behind the transfer sheet. The blotting roller removes excess liquid prior to fusing the image in a fusing station. The Simms et al. patent (U.S. Pat. No. 5,965,314) discloses an absorptive belt to draw off liquid toner carrier liquid from a wet image located on an image carrying member such as an electrostatographic imaging member or intermediate transfer member. The belt is semiconductive and is passed over a roller that is biased to a potential of the same polarity as that of the toner particles. Fluid is removed from the belt by a squeegee roller. The Larson et al. patent (U.S. Pat. No. 5,839,037) discloses a multicolor imaging electrostatographic apparatus including a photoconductive imaging belt passing through a plurality of color stations wherein each color station forms a different color liquid developed toner image on the belt, each successive image being formed in registry on top of the priorly formed toner images. After an individual color toner images has been developed on the belt, an absorptive blotter roller biased to a potential having the same sign as the respective toner particles is used to absorb carrier fluid. The roller is porous and has a central chamber connected to a vacuum for removing liquid continuously. When a full color image has been formed on the imaging belt, it is transferred to a second belt. The full color image is then transported to come into contact with an absorptive belt for removing additional carrier fluid, after which the full color toner image is heated, thereby forming two phases including a toner-rich phase and a nearly pure carrier phase. The heated full color toner image is then transferred to a receiver under transfix conditions, i.e., without the need for an electric field. The Lewis patent (U.S. Pat. No. 5,987,284) discloses a xerographic method and apparatus for conditioning a liquid developed image. A metering roller is used to remove excess carrier liquid from a liquid developed toner image, and subsequently an electrically biased roller is used to electrostatically compress the toner image, e.g., on an imaging member or on an intermediate transfer member. The roller is porous and includes a central chamber connected to a vacuum for removing carrier liquid continuously. The Seong-soo Shin et al. patent (U.S. Pat. No. 6,085,055) discloses an external blotter roller for removing excess carrier liquid from a liquid developed electrophotographic image formed on a photoconductive belt. Liquid is thermally removed from the roller by evaporation, the roller being contacted and heated by heating rollers. The vapors are condensed to liquid which is collected.

Dispersions such as liquid developers for use in electrophotography and nonaqueous inks for use in ink jet recording have in common the use of an organic carrier fluid, typically a hydrocarbon. In particular, mixed alkanes commercially marketed by the Exxon Corporation under the trade name, Isopar, are useful. Various Isopars having different flash points and evaporation rates are available. Liquid developers made with Isopars having flash points greater than 140° F., e.g., Isopar L and Isopar M, have been disclosed in the Santilli et al. patent (U.S. Pat. No. 5,176,980). Nonaqueous inks including Isopars are disclosed by the Nicholls patent (European Patent No. 0939794), the Nicholls at al. patent (U.S. Pat. No. 5,453,121), the Kohyama patent (U.S. Pat. No. 6,126,274) and the Kato patent (U.S. Pat. No. 6,133,341), cited above.

An imaging method and apparatus involving electrocoagulation of a primarily aqueous dispersion has been disclosed by the Castegnier et al. patents (e.g., U.S. Pat. Nos. 3,892,645, 4,555,320, 4,661,222, 4,895,629, 5,538,601, 5,609,802, 5,693,206, 5,727,462, 5,908,541 and 6,045,674) wherein an electric current is passed between a positive electrode (or an array of positive electrodes) and a negative electrode (in an array of negative electrodes) to produce an electrocoagulated deposit on the positive electrode. An imagewise electrocoagulated deposit may be transferred to a receiver such as paper to form a single color image, e.g., a black image, on the paper. Alternatively, imagewise electrocoagulated deposits of different colors may be sequentially deposited, e.g., on a positively biased belt, so as to form a full color image for subsequent transfer to a receiver. There is no disclosure for using an intermediate member in conjunction with electrocoagulation. A squeegee blade apparatus for removing excess liquid is disclosed in the Castegnier et al. patents (U.S. Pat. Nos. 5,928,486 and 6,090,257). A difficulty inherent in the electrocoagulation technique is that image uniformity requires an extremely accurate distance between each pair of opposing positive and negative electrodes, typically about 50 micrometers. Moreover, the image resolution is limited by the diameter of individually addressable electrodes and also by the fact that these electrodes must be isolated from one another by a thickness of insulating material between them. There are other difficulties, e.g. that the electrical power density required for creating an electrocoagulated image is relatively high, that special materials are needed to suppress unwanted gas generation near the electrodes, and that electrodes must be protected against electrolytic erosion. The Castegnier et al. patent (U.S. Pat. No. 4,555,320) discloses a relatively low resolution of 200 dots per inch requiring 25 watts of power (50 volts, 500 ma) to produce 100,000 developed dots per second, which is equivalent to about 100 microcoulombs of charge delivered in about 0.4 second per developed dot, resulting in a significant power density of about 4.1 watts/in$^2$ if every imaging pixel is developed (maximum density flat field image). The Castegnier patent (U.S. Pat. No. 4,764,264) discloses a resolution of 200 dots per inch requiring 25 watts of power to produce 1,000,000 developed dots per second, each developed dot requiring passage of 25 microcoulombs of charge.

There remains a need for a simplified, non-electrostatographic method for forming high resolution color images, which simplified method does not include any electrostatic latent image, nor development of any latent image by an electroscopic toner, nor a first transfer of any developed electroscopic toner image to an intermediate transfer member for a subsequent second transfer to a receiver member. Moreover, there remains a need to improve upon the electrocoagulation imaging method as disclosed in U.S. Pat. Nos. 3,892,645, 4,555,320, 4,661,222, 4,895,629, 5,538,601, 5,609,802, 5,693,206, 5,727,462, 5,908,541 and 6,045,674 cited above, which method requires high power density and an expensive write head, has limited resolution, and has problems with electrochemical erosion of the electrodes and gas generation by the electrodes. Furthermore, there remains a need to circumvent problems associated with apparatus such as described for example in above-cited U.S. Pat. Nos. 5,992,756, 6,019,455, 6,126,274 and 6,133,341, in which a pigmented ink is concentrated in an ink jet write head so as to eject agglomerates of toner particles, the main problems including plateout of ink particles in the write head, ink replenishment and liquid flow problems in the write head, and the need for a complicated electrode configuration in an expensive write-head.

SUMMARY OF THE INVENTION

The invention provides a digital imaging method and apparatus including: an ink jet device utilizing a coagulable ink, an intermediate member upon which a primary ink jet image is formed from ink droplets produced by the ink jet device, a physical or chemical agent or a mechanism to cause a formation of coagulates in the primary ink jet image on an operational surface of the intermediate member, a mechanism for removing excess liquid from the coagulates, a transfer mechanism for transferring the liquid-depleted coagulates to a receiver member, and a regeneration device for regenerating the operational surface prior to forming a new primary image thereon. The ink includes aqueous-based and nonaqueous dispersions and single-phase solutions of a soluble coagulable colorant or a dye.

More particularly, the invention provides a digital imaging method and apparatus including: an ink jet device utilizing an ink containing dispersed pigmented particles in aqueous-based or nonaqueous colloidal dispersions, an intermediate member upon which a primary ink jet image is formed from ink droplets produced by the ink jet device, an agent or mechanism to cause physical or chemical aggregation of the pigmented particles into flocs, coagulates or agglomerates so as to form an aggregated ink jet image on the intermediate member, a mechanism for removing excess liquid from the flocculated, coagulated or agglomerated pigmented particles so as to form a liquid-depleted image from the primary image, a transfer mechanism for transferring the aggregated pigmented particles of the liquid-depleted image to a receiver member, and a regeneration device for removing from the operational surface residual material remaining on the operational surface after the transferring of the liquid-depleted image to the receiver.

In one aspect of the invention, the ink jet ink is an aqueous-based dispersion of pigmented particles. In one embodiment, the aggregation of the particles in the primary ink jet image is produced by a heating or a cooling of the primary image on the intermediate member. In other embodiments, the aggregation of the particles in the primary ink jet image is produced by an added salt dissolved in the liquid of the primary image. In yet other embodiments, the aggregation of the particles in the primary ink jet image is produced by altering the pH of the liquid of the primary image. In further embodiments, the aqueous-based ink has a steric stabilization produced by polymeric moieties adsorbed on the surfaces of the pigmented particles, and the aggregation of the particles in the primary ink jet image is induced by causing a desorption, or decomposition, of the sterically stabilizing moieties. In still further embodiments, the aggregation of the particles in the primary ink jet image is produced by an electrocoagulation using an electrode external to the intermediate member. In yet another embodiment, a sterically stabilized nonaqueous primary ink jet image is destabilized by adding dissolved polymeric molecules which are soluble in (compatible with) the aqueous-based carrier liquid. In still yet another embodiment, a hetero-colloid is added to the primary image to form hetero-coagulates.

In another aspect of the invention, the ink jet ink is a nonaqueous dispersion of pigmented particles. In one embodiment, the aggregation of the particles in the primary ink jet image is produced by a heating or a cooling of the primary image on the intermediate member. In other embodiments the nonaqueous ink has a steric stabilization produced by polymeric moieties adsorbed on the surfaces of the pigmented particles, which moieties having chains extending into and soluble in the carrier fluid of the ink jet ink dispersion, and the aggregation of the particles in the primary ink jet image is induced by a destabilizing liquid or solvent that comes into contact with and mixes miscibly with the liquid of the primary image, the polymeric chains of the moieties being insoluble in the destabilizing liquid. In further embodiments, the nonaqueous ink has a steric stabilization produced by polymeric moieties adsorbed on the surfaces of the pigmented particles, and the aggregation of the particles in the primary ink jet image is induced by causing a desorption, or a decomposition, of the sterically stabilizing moieties. In yet a further embodiment, a sterically stabilized nonaqueous primary ink jet image is destabilized by adding dissolved polymeric molecules which are soluble in (compatible with) the nonaqueous carrier liquid of the primary ink jet image.

In certain embodiments of the invention in which the ink is a nonaqueous dispersion, the liquid removal mechanism to form a concentrated image is similar to any known mechanism for removing a carrier liquid from a liquid-developed toner image situated on an electrostatographic primary imaging member or on an electrostatographic intermediate transfer member.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings, some elements have been removed, and relative proportions depicted or indicated of the various elements of which disclosed members are composed may not be representative of the actual proportions, and some of the dimensions may be selectively exaggerated.

DETAILED DESCRIPTION OF THE PREFERRED EMBODIMENTS

The invention provides an improved method and apparatus for ink jet imaging, the apparatus employing an ink jet device utilizing a coagulable ink. The coagulable ink may include a dissolved coagulable dye, or the coagulable ink may be an aqueous-based or a nonaqueous colloidal dispersion of particles, preferably pigmented particles, in a carrier liquid. The ink jet device produces ink droplets according to a known manner for deposition on an intermediate member, which intermediate member has an operational surface upon which a primary ink jet image is formed by the ink jet device. An image-aggregating agent or mechanism causes a coagulable ink to form coagulates within the primary image resulting in an aggregated image. In particular, the image-aggregating agent or mechanism causes particles in an aqueous-based or a nonaqueous colloidal dispersion of particles in the primary ink jet image to form an aggregated image containing flocs, coagulates or agglomerates. In certain embodiments of the invention, particles, flocs, coagulates or agglomerates are caused to be moved by an image-concentrating mechanism into proximity with the operational surface to form a concentrated aggregated image. A liquid removing mechanism for removing excess liquid from the flocs, coagulates or agglomerates produces a liquid-depleted aggregated image or "dried" image on the intermediate member. Finally, a transfer mechanism is provided for transferring the liquid-depleted aggregated image from the intermediate member to a receiver member, and a regeneration mechanism is subsequently employed to regenerate the operational surface of the intermediate member prior to forming a new primary image thereon.

Figures 1A, 1B, 1C:
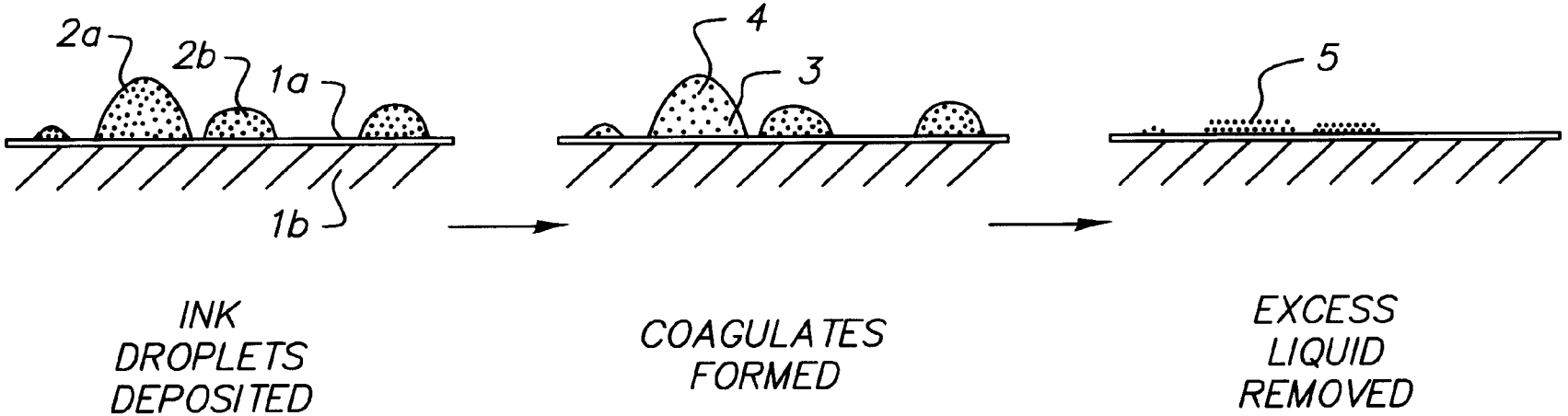
FIG. 1*a,b,c* schematically depicts certain process steps for practicing the invention according to an aspect of the invention.

Referring now to the accompanying drawings, FIG. 1*a,b,c* schematically shows a progression from a primary ink jet image to a liquid-depleted aggregated image according to an aspect of the invention. FIG. 1*a* is a sketch of a portion of a digitally formed primary image having a gray scale, in which individual imaging pixels are shown to contain variable quantities of a colloidal ink jet liquid ink deposited as a dispersion of particles in a carrier liquid on the operational surface, indicated by the numeral 1, of the intermediate member, 1*b*. As is well known, such a variation in the amount of liquid can be produced by an imagewise delivery of multiple ink droplets per pixel. For example, an as-deposited liquid ink amount labeled 2*a* is formed by a greater number of droplets than an amount labeled 2*b* on an adjacent pixel. To produce a gray scale, an imaging pixel of the primary image may have zero ink deposited, or pixel may contain a plurality of droplets, e.g., as many as twenty or more droplets per pixel to achieve maximum image density, as is known in the art. As is also well known, ink jet ink droplets having a variable size may be created by an ink jet device, thereby providing an alternate way of creating a gray scale. FIG. 1*b* illustrates schematically the result of forming the aggregated image from the primary image, and shows flocs, coagulates or agglomerates 3 of particles suspended in a particulate-depleted liquid 4. Liquid 4 is primarily carrier liquid of the original ink. Preferably, liquid 4 contains a negligible number of particles remaining from the original ink composition. FIG. 1*c* shows a sketch of the liquid-depleted aggregated image after liquid 4 of FIG. 1*b* has been removed, which liquid 4 is excess liquid. The liquid-depleted image of FIG. 1*c* may herein be referred to as a "dried" image. However, the liquid-depleted image can in certain cases retain any significant amount of liquid (no such residual liquid is shown in FIG. 1*c*). Although for simplicity of exposition only three thicknesses of liquid-depleted material are illustrated in FIG. 1*c*, it will be henceforth understood in the described embodiments that for high quality imaging there will be many density level differences between Dmin and Dmax, with pixels containing corresponding thicknesses of marking material to create these density level differences. Descriptions of how an aggregated image and a liquid-depleted image may be formed and transferred to a receiver are given below.

Figure 2:
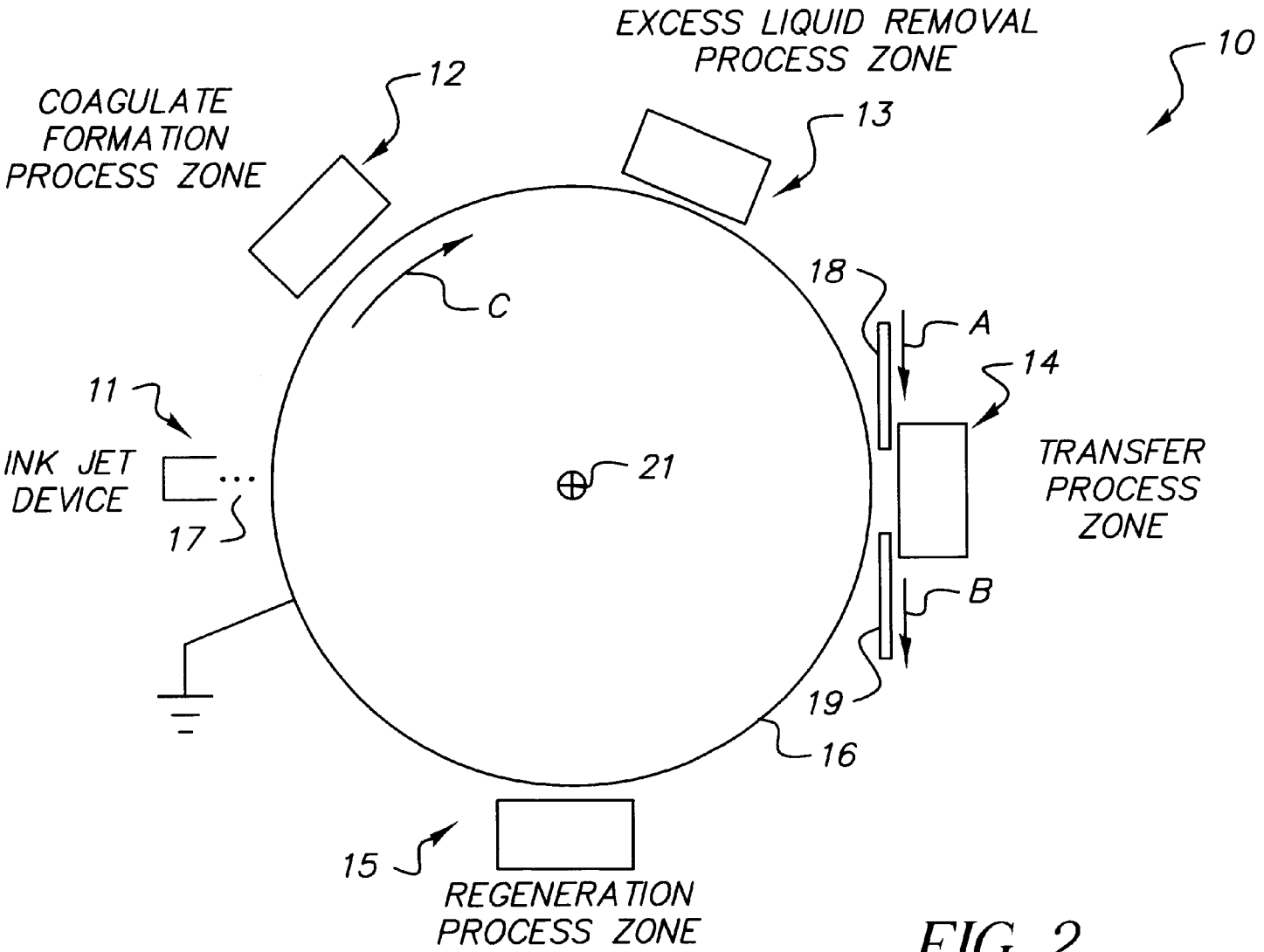
FIG. 2 is a schematic side elevational view of a generalized embodiment of an apparatus of the invention showing both specific and generalized components thereof.

FIG. 2 shows a preferred embodiment of a ink jet imaging apparatus for creating gray scale images according to the invention. The imaging apparatus, designated generally by the numeral 10, includes: an ink jet device 11 for depositing ink droplets 17 to form a primary ink jet image on the operational surface of an intermediate member 16 mounted on shaft 21 rotating in a direction of an arrow labeled C, a Coagulate Formation Process Zone 12 for forming an aggregated image, an Excess Liquid Removal Process Zone 13 for forming a liquid-depleted aggregated image, a Transfer Process Zone 14 for transferring the liquid-depleted aggregated image from intermediate member 16 to a receiver member, and a Regeneration Process Zone 15 for preparing the intermediate member for a fresh primary image. A receiver sheet 18, moving in a direction of arrow A, is shown approaching Transfer Process Zone 14. A receiver sheet 19 is shown leaving the Transfer Process Zone in a direction of arrow B. Receiver 19 carries a liquid-depleted material image derived from a primary ink jet image previously formed by ink jet device 11 on intermediate member 16, which liquid-depleted material image is transferred in Process Zone 14 from intermediate member 16 to a receiver, e.g., receiver 19. Intermediate member roller 16 may be rotated by a motor drive applied to shaft 21, or alternatively by a frictional drive produced by a frictional engagement with another rotating member (not shown).

In an alternate embodiment, intermediate member 16 may be in the form of an endless web onto which is deposited a primary ink jet image by ink jet device 11, which web is driven or transported past or through the various Process Zones 12, 13, 14 and 15. The liquid-depleted material image is transferred from the web to a receiver member in Transfer Process Zone 14.

Coagulate Formation Process Zone 12, Excess Liquid Removal Process Zone 13, Transfer Process Zone 14 and Regeneration Process Zone 15 may include the use of rotatable elements. The rotatable elements of the subject invention are shown as both rollers and webs in the examples of this description but may also include drums, wheels, rings, cylinders, belts, loops, segmented platens, platen-like surfaces, and receiver members which receiver members include receiver members moving through nips or adhered to drums or transport belts.

Although Coagulation Formation Process Zone 12, Excess Liquid removal Process Zone 13, Transfer Process Zone 14 and Regeneration Process Zone 15 are shown as discrete zones in FIG. 2, in certain embodiments there may not be a distinct separation of zones, i.e., there may be a physical or functional overlapping or even complete merging of zones, as will be clarified below.

The ink jet device 11 may include any known apparatus for jetting droplets of a liquid ink in a controlled imagewise fashion on to the operational surface of intermediate member (IM) 16, with digital electronic signals controlling in known manner a variable number of droplets delivered to each imaging pixel on the operational surface. A primary image made on the operational surface by the liquid ink droplets may be a continuous tone image, or it may be a half-tone image including gray-level half-tones, frequency modulated half-tones, area-modulated half-tones and binary halftones as are well known in the art. It should be understood that the conventional and well-known terms "continuous tone" and "half-tone" refer not only to any place-to-place variations of the quantity of ink within the image on the operational surface, but also to any corresponding color or density that may subsequently be produced or induced in imagewise fashion by these same variations of the quantity of ink. The operational surface includes any portion of the surface of the IM 16 upon which a primary ink jet image may be formed by ink jet device 11. An imaging pixel is defined in terms of the image resolution, such that if the resolution were, say, 400 dots per inch (dpi), then a square pixel for example would occupy an area on the operational surface having dimensions of 63.5 $\mu$m×63.5 $\mu$m. Thus, an imaging pixel is a smallest resolved imaging area in a primary image. The ink jet device 11 includes a continuous ink jet printer or a drop-on-demand ink jet printer including a thermal type of ink jet printer, a bubble-jet type of ink jet printer, and a piezoelectric type of ink jet printer. A drop-on-demand ink jet printer is preferred. Ink jet device 11 typically has a writehead (not shown) which includes a plurality of electronically controlled individually addressable jets, which plurality may be disposed in a full-width array, i.e., along the operational width of intermediate member 16 in a direction parallel to the axis of shaft 21. Alternatively, as is well known, the writehead may include a relatively smaller array of jets and the writehead is translated back and forth in directions parallel to the axis of shaft 21 as the operational surface of intermediate member 16 rotates. The ink used by the ink jet device 11 is provided from a reservoir (not shown) and it is preferred that the composition of the ink droplets 17 be substantially the same as the composition of the ink in the reservoir. The ink jet head preferably produces a negligible segregation of components of the ink, i.e., certain components are not intentionally preferentially retained by the writehead and certain other components are not intentionally preferentially jetted in the droplets 17. More specifically, it is preferred that no applied fields are used in the writehead, e.g., such as when using a colloidal particulate ink so as to increase the number of particles per unit volume in the jetted droplets 17 to a value higher than the number of particles per unit volume within the reservoir.

An ink used to form droplets 17 includes nonaqueous and aqueous-based inks, which inks are preferably colloidal dispersions of particles in a carrier liquid or fluid. Preferably, the particles are pigmented particles, and more preferably, solid pigmented particles. However, particles which are not colored may be used, including solid or liquid particles containing precursor chemicals that may be subsequently transformed, by any suitable chemical or physical process, into a material image having any useful property, composition or color, e.g., transformed when an ink-jet-ink-derived image is located either on intermediate member 16 or on a receiver, e.g., receiver 19. The carrier fluid of an aqueous-based colloidal ink dispersion may be water, or it may contain a proportion, typically a minor proportion, of any suitable miscible nonaqueous solvent. A volume percentage of dispersed particulates in a nonaqueous or aqueous-based colloidal ink useful in the invention may have any suitable value, typically between about 3% and 50%. Formulations similar to, or identical with, commercially available (nonaqueous) electrophotographic liquid developers may be used as inks for practicing the invention. Formulations similar to, or identical with, commercially available pigmented ink jet inks, including both nonaqueous and aqueous-based ink jet inks, may also be used for practicing the invention. Inks useful for the invention may be sterically stabilized colloids, electrostatically stabilized colloids such as a typical aqueous-based ink dispersion, or may include both steric and electrostatic stabilization, such as a typical electrophotographic liquid developer. Methods and materials for stabilization of both nonaqueous and aqueous-based dispersions are well known (see for example references cited above, in the section describing the background of the invention). For nonaqueous colloidal inks useful in the invention, the particles may be both sterically and electrostatically stabilized, i.e., the particles may carry an electrostatic charge with counterions present in the surrounding carrier fluid providing overall electrical neutrality. The particle sizes or particle size distributions of the particles used in a colloidal ink for practicing the invention are similar to the particle sizes or particle size distributions of the particles used in colloidal particulate dispersions including commercial electrophotographic liquid developers and commercial ink jet inks. Particulate ink dispersions useful for practice of the invention may be made by any known method, including grinding methods, precipitation methods, spray drying methods, limited coalescence methods, and so forth. Particulate ink dispersions useful for practice of the invention may be formulated in any known way, such as by including dispersal agents, stabilizing agents, drying agents, glossing agents, and so forth. Pigmented particles used in ink dispersions of the invention may include one or more pigments, plus suitable binders for the pigments. A binder is typically made of one or more synthetic polymeric materials, which polymeric materials are selected to have good fusing properties for fusing a pigmented particulate image to a receiver for creating an output print, as described more fully below. The pigments are preferably commercially available pigments and may be crystalline or amorphous. Typically, a pigment is comminuted to very small sizes, e.g., subnanometer sizes, and dispersed substantially uniformly in the binder by known methods. It is preferred that pigments and binders used to make inks for the invention are substantially insoluble in the carrier liquid of the dispersion. For nonaqueous inks, it is preferred to use one or more hydrocarbon alkanes for the primary component of the carrier liquid, although any suitable nonaqueous liquid may be used. Particularly useful are mixtures of alkanes marketed by Exxon under the tradename Isopar, and various Isopars are available. Preferred Isopars are those having a flash point of 140° F. and above, such as Isopar L and Isopar M. However, other, lower molecular weight Isopars, such as Isopar G, may be used. It is also preferred to employ a precursor dispersion that may be manufactured as a concentrate having a high volume percentage of particulates, which concentrate is diluted with carrier fluid to form a resulting ink prior to introducing the ink into the reservoir of the ink jet device 11.

Notwithstanding the description of inks in the previous paragraph above, any coagulable ink may be used in the practice of the invention, including non-colloidal solutions and electrocoagulable inks.

In order to inhibit sticking of particles of a colloidal ink dispersion to any interior walls or surfaces of the writehead of ink jet device 11, including the interiors of the jets, it is preferred that the surface characteristics of the interior walls or surfaces be such that particles in the dispersion are repelled by the interior walls or surfaces, and also preferably that the carrier liquid of the ink jet ink does not wet the interior walls or surfaces. For example, when using a nonaqueous hydrophobic ink, it is preferable to provide hydrophilic interior walls or surfaces. Similarly, when using an aqueous-based hydrophilic ink, it is preferable to provide hydrophobic interior walls or surfaces. Also, it is preferred that colloidal ink particles include sterically stabilizing polymeric moieties adsorbed on their surfaces, which moieties inhibit close approach of the particles to the interior walls or surfaces.

Coagulate Formation Process Zone 12 includes any suitable agent or process for causing coagulate formation within the ink included in a primary image, which process includes the use of any suitable technique including the use of any suitable imposed ambient physical condition or any suitable chemical agent. Coagulate-inducing devices, processes, ambient conditions and chemical agents are described more fully below, and include use of a Salt Effect, a pH effect, a Solvent Effect, a mechanism for destroying the stabilizer of a sterically stabilized ink colloid, a heating or a cooling, an electrocoagulation, an addition to a primary image of a hetero-colloid having charged particles of opposite polarity to the polarity of the particles of the ink jet device, and, an addition to a primary image of a coagulate-inducing polymer.

In the Excess Liquid Removal Process Zone 13, excess liquid is removed from the coagulates formed in the Coagulate Formation Process Zone 12. In general, a portion, preferably a major portion, of the liquid is removed from the coagulates so as to form a liquid-depleted image, which liquid-depleted image can in certain cases retain a significant amount of residual liquid. In certain circumstances substantially all of the liquid may be removed to form the liquid-depleted image. Excess Liquid Removal Process Zone 13 includes an excess liquid removal device which is any of the following known devices: a squeegee (roller or blade), an external blotter device, an evaporation device, a vacuum device, a skiving device, and an air knife device. These excess liquid removal devices are described more fully below. Any other suitable excess liquid removal device or process may be used.

Transfer Process Zone 14 for transferring an ink-jet-ink-derived material image from intermediate member (IM) 16 to a receiver member includes any known transfer device, e.g., an electrostatic transfer device, a thermal transfer device, and a pressure transfer device, described more fully below. As is well known, both an electrostatic transfer device and a thermal transfer device can be used with an externally applied pressure. An electrostatic transfer device for use in Transfer Process Zone 14 typically includes a backup roller (not shown), which backup roller is electrically biased by a power supply (not shown). The backup roller co-rotates in a pressure nip relationship with IM 16, and a receiver member such as sheet 18 is translated through the nip formed between the backup roller and IM 16. An ink-jet-ink-derived material image carrying an electrostatic net charge is transferable by an electrostatic transfer device from IM 16 to the receiver, i.e., an electric field is provided between IM 16 and the backup roller to urge transfer of the ink-jet-ink-derived material image. For use to augment electrostatic transfer when an ink-jet-ink-derived material image on IM 16 has a low electrostatic charge or is uncharged, a charging device (not shown) such as for example a corona charger or a roller charger or any other suitable charging device may be located between Excess Liquid Removal Process Zone 13 and Transfer Process Zone 14, which charging device may be used to suitably charge the ink-jet-ink-derived liquid-depleted material image prior to subsequent electrostatic transfer of the material image in Transfer Process Zone 14. Alternatively, a thermal transfer device may be used to transfer the ink-jet-ink-derived material image, which thermal transfer device can include a heated backup roller (not shown), which backup roller is heated by an external heat source such as a source of radiant heat or by a heated roller (not shown) contacting the backup roller (not shown). Alternatively, the backup roller for thermal transfer can be heated by an internal source of heat. The backup roller for thermal transfer co-rotates in a pressure nip relationship with IM 16, and a receiver member such as sheet 18 is translated through the nip formed between the heated backup roller and IM 16. In certain embodiments, IM 16 may be similarly heated, either from an internal or external source of heat. As an alternative, a thermal Transfer Process Zone 14 may include a transfusing device, wherein an ink-jet-ink-derived material image is thermally transferred to and simultaneously fused to a receiver. As yet another alternative, a pressure transfer device may be used in Transfer Process Zone 14 to transfer an ink-jet-ink-derived material image, which pressure transfer device includes a backup pressure roller (not shown) which pressure roller co-rotates in a pressure nip relationship with IM 16, and a receiver member such as sheet 18 is translated through the nip formed between the pressure backup roller and IM 16. In such a pressure transfer device, an adhesion of the ink-jet-ink-derived material image is preferably much greater on the surface of the receiver than on the operational surface of IM 16, and preferably the adhesion to the operational surface of IM 16 is negligible.

As an alternative to the use of receiver sheets such as sheets 18,19 in the Transfer Process Zone of any of the above-described embodiments, a receiver in the form of a continuous web (not illustrated) may be used in Transfer Process Zone 14, which web passes through a pressure nip formed between intermediate member 16 and a transfer backup roller (not illustrated). A receiver in the form of a continuous web may be made of paper or any other suitable material.

In other alternative embodiments, a transport web (not illustrated) to which receiver sheets are adhered may be used in Transfer Process Zone 14 to transport receiver sheets through a pressure nip formed between intermediate member 16 and a transfer backup roller (not illustrated).

A receiver, for example receiver 19, which has passed through Transfer Process Zone 14 may be moved in the direction of arrow B to a fusing station (not shown in FIG. 2).

Apparatus 10 may be included as a color module in a full color ink jet imaging machine. A receiver such as receiver 19, which has received an ink-jet-ink-derived material image of a particular color from IM 16, may be transported to another apparatus or module entirely similar to apparatus 10, wherein an ink-jet-ink-derived material image of a different color may be transferred from a similar intermediate member in a similar Transfer Process Zone, which different color image is transferred atop and in registration with the ink-jet-ink-derived material image transferred to the receiver in apparatus 10. In a set of such similar modules arranged in tandem, ink-jet-ink-derived material images forming a complete color set may be successively transferred in registry one atop the other, thereby creating a full color material image on a receiver. The resulting full color material image may then be transported to a fusing station wherein the material image is fused to the receiver.

The operational surface of intermediate member 16, after leaving the Transfer Process Zone 14, is rotated to a Regeneration Process Zone 15 where the operational surface is prepared for a new primary image to be subsequently formed by ink jet device 11. In one embodiment, the Regeneration Process Zone is a cleaning process zone wherein residual material of the liquid-depleted material image is substantially removed using known devices or methods, including use of a cleaning blade (not shown) or a squeegee (not shown) to scrape the operational surface substantially clean. Alternatively, a cleaning roller (not shown) is provided to which residual material of the liquid-depleted material image adheres, thereby producing a substantially clean operational surface in Regeneration Process Zone 15. Any other known suitable cleaning mechanisms may be used to form a regenerated surface, including brushes, wipers, solvent applicators, and so forth (not shown).

In an alternative embodiment including a Regeneration Process Zone 15, any residual carrier liquid that might still be retained by intermediate member 16 after leaving the Transfer Process Zone 14 is removed in conjunction with, or in tandem with, removal of any unwanted solids, such as for example using a squeegee (not shown). Alternatively, a relatively hard squeeze roller (not shown) may be used for squeezing excess liquid out of intermediate member 16, which squeezed out liquid may be collected and recycled. For removing relatively small amounts of residual liquid, a source of heat can be provided in Regeneration Process Zone 15 to suitably cause evaporation of any residual carrier liquid (which resulting vapor may be condensed and recycled). The source of heat (not illustrated) may be internal to intermediate member 16, or may be externally provided, such as for example by a heated roller (not shown) or by a radiant energy source (not shown). Alternatively, residual liquid may be absorbed in Regeneration Process Zone 15 by an external blotter (not shown), which blotter being for example in the form of a roller or a web contacting the operational surface of intermediate member 16. As another alternative, an external vacuum device (not shown) may be used in Regeneration Process Zone 15 to suck up and possibly recycle any residual liquid from the operational surface of intermediate member 16.

Figure 3:
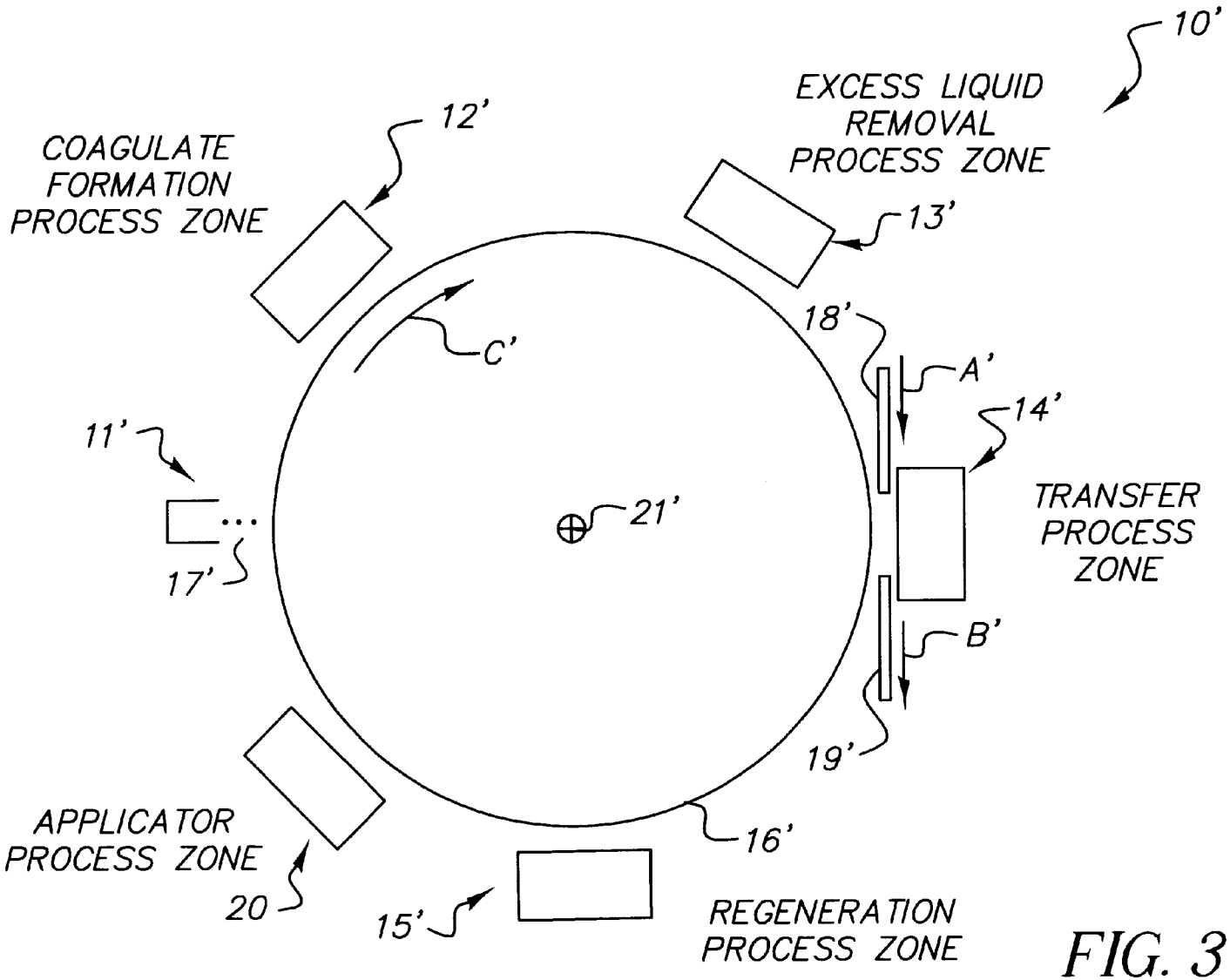
FIG. 3 is a schematic side elevational view of an alternative generalized embodiment of the apparatus of the invention shown in FIG. 2.

Turning now to an alternative embodiment of FIG. 3, an apparatus 10' for creating gray scale images according to the invention is depicted which is similar to apparatus 10 except that this alternative embodiment further includes an Applicator Process Zone 20 for forming a pre-coated intermediate member 16', which Applicator Process Zone is located between the Regeneration Process Zone 15' and ink jet device 11'. In FIG. 3, primed (') entities are in all respects similar to the corresponding unprimed entities in FIG. 2. In the Applicator Process Zone 20, a coating of a coagulate-inducing material or reagent, in the form of either a solid or preferably a liquid, is deposited on a regenerated operational surface of intermediate member 16' after leaving the Regeneration Process Zone 15', which coating acts to promote formation of coagulates in the Coagulate Formation Process Zone 12', as described in certain embodiments below. In addition to the various devices and processes described above in relation to Regeneration Process Zone 15 of apparatus 10, the Regeneration Process Zone 15' of apparatus 10' may also include a mechanism for removing a residue of a reagent or material previously deposited on the intermediate member 16' in Applicator Process Zone 20. Thus for example it may be desirable to provide a mechanism for wiping off or dissolving such a residue, e.g., by using a damp sponge roller (not shown) or a spray device (not shown) followed by use of a tandem associated blotter device (not shown) or wiper member (not shown), or by using any other suitable mechanism for removal of such a residue.

Generally, what is meant by the term "Coagulate Formation Process Zone" is that an action or process producing coagulates in a primary image on the surface of intermediate member 16, 16' may take place anywhere in a zone located between the ink jet device 11, 11' and the Excess Liquid Removal Process Zone 13, 13'. Thus, with specific reference to FIG. 3, the Coagulate Formation Process Zone shown generically as 12' may not in fact have a localized existence as such. As an example, in certain embodiments described more fully below, a formation of coagulates may be induced by an internal heater located within intermediate member 16', and the heating from the heater will not generally be localized to the Coagulate Formation Process Zone 12'. Also, the Coagulate Formation Process Zone 12' may not require use of an actual device. For example, in certain other embodiments described more fully below, a coagulate-inducing reagent or material deposited in Applicator Process Zone 20 may cause a very rapid formation of coagulates in ink jet ink droplets 17' after the droplets have landed on the operational surface of intermediate member 16', without the need for a coagulate-inducing device or piece of apparatus situated between the ink jet device 11' and the Excess Liquid Removal Process Zone 13'.

Figure 4:
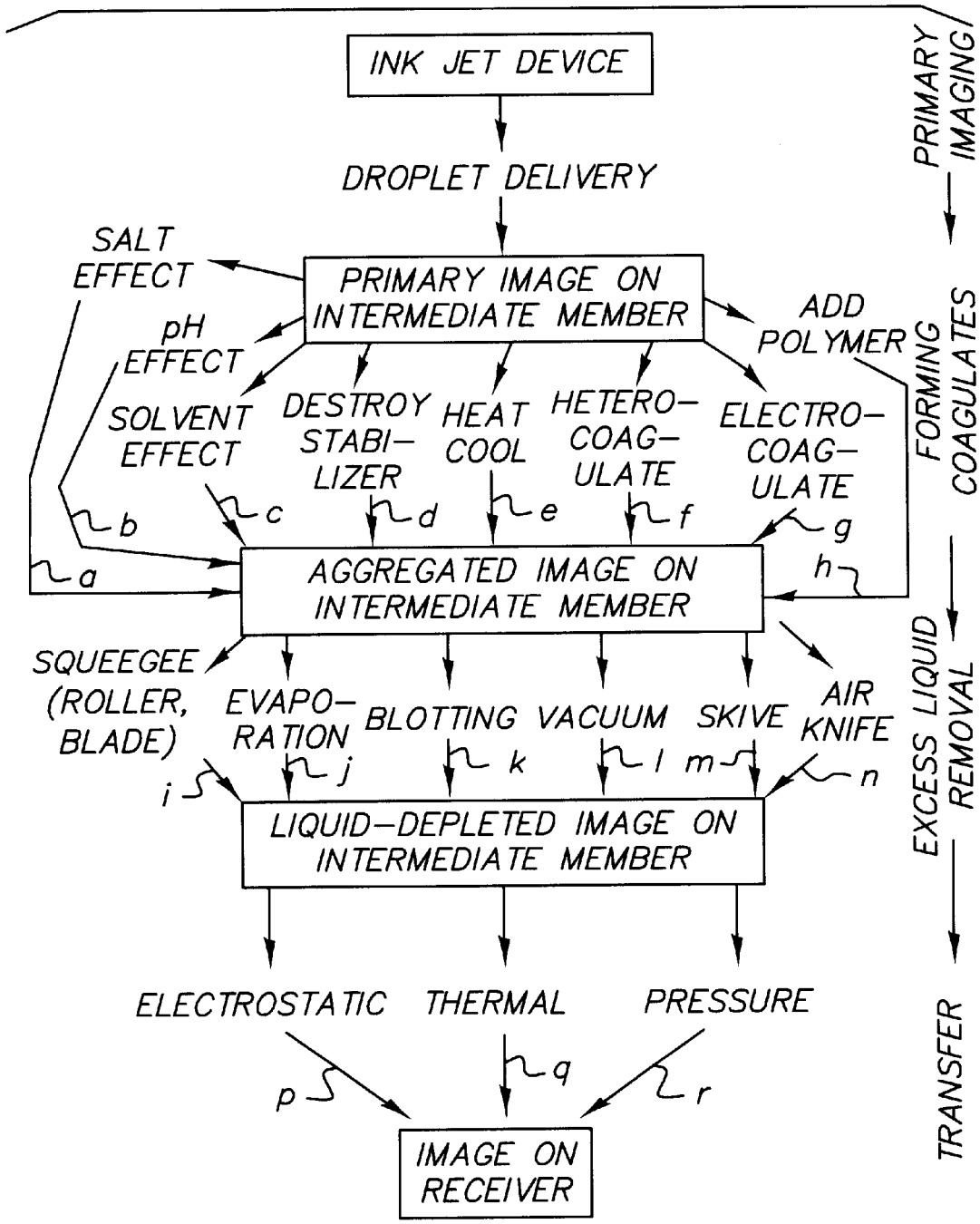
FIG. 4 is a flow chart illustrating a set of various pathways of steps for practicing the invention.

FIG. 4 is a flow chart, relating to portions of FIG. 2, the flow chart showing in abbreviated fashion various sets of steps for practicing the invention. Thus, starting at the top right of FIG. 4, the right hand column indicates passage from the ink jet device 11 through successive Process Zones 12, 13 and 14 for successively forming coagulates in the primary image, removing excess liquid, and transferring the liquid-depleted ink-jet-ink-derived image to a receiver. According to the invention, after a primary image is formed on the intermediate member (IM) 16, there are various possible routes to reach the condition of a coagulated or aggregated image described herein above with reference to FIG. 1, which routes are indicated by the arrows labeled as a, b, c, d, e, f, g, and h. These arrows indicate at least eight different routes and any other suitable routes may be used. The arrows labeled as i, j, k, l, m, and n indicate at least six different routes to proceed from an aggregated image to a liquid-depleted or "dried" image on the intermediate member, and any other suitable routes may be used. Following formation of the "dried" image, the transfer routes for transfer to a receiver as described in detail above are symbolized by the three arrows labeled l, m, and n, i.e., representing respectively electrostatic, thermal and pressure transfer (combinations of electrostatic, thermal and pressure mechanisms for transfer are implicitly included also). With reference to FIG. 2, FIG. 4 shows possible routes from a primary image on an IM to an ink-jet-ink-derived material image on a receiver member, any one of which routes can be represented in brief as follows:

[(a, b, c, d, e, f, g, h); (i, j, k, l, m, n); (p, q, r)]

where it is to be understood that, counting heating and cooling each as a separate step (arrow e) at least 9×6×3=162 possible routes are contemplated, e.g., [a; i; p], [a; i; q], . . . , and so forth. However, in certain embodiments, individual process steps may be combined or used together. Thus for example a heating or a cooling may be combined with any of the other process steps, or alternatively any other useful combinations of steps a, b, . . . , g, h may be used.

Figure 5:
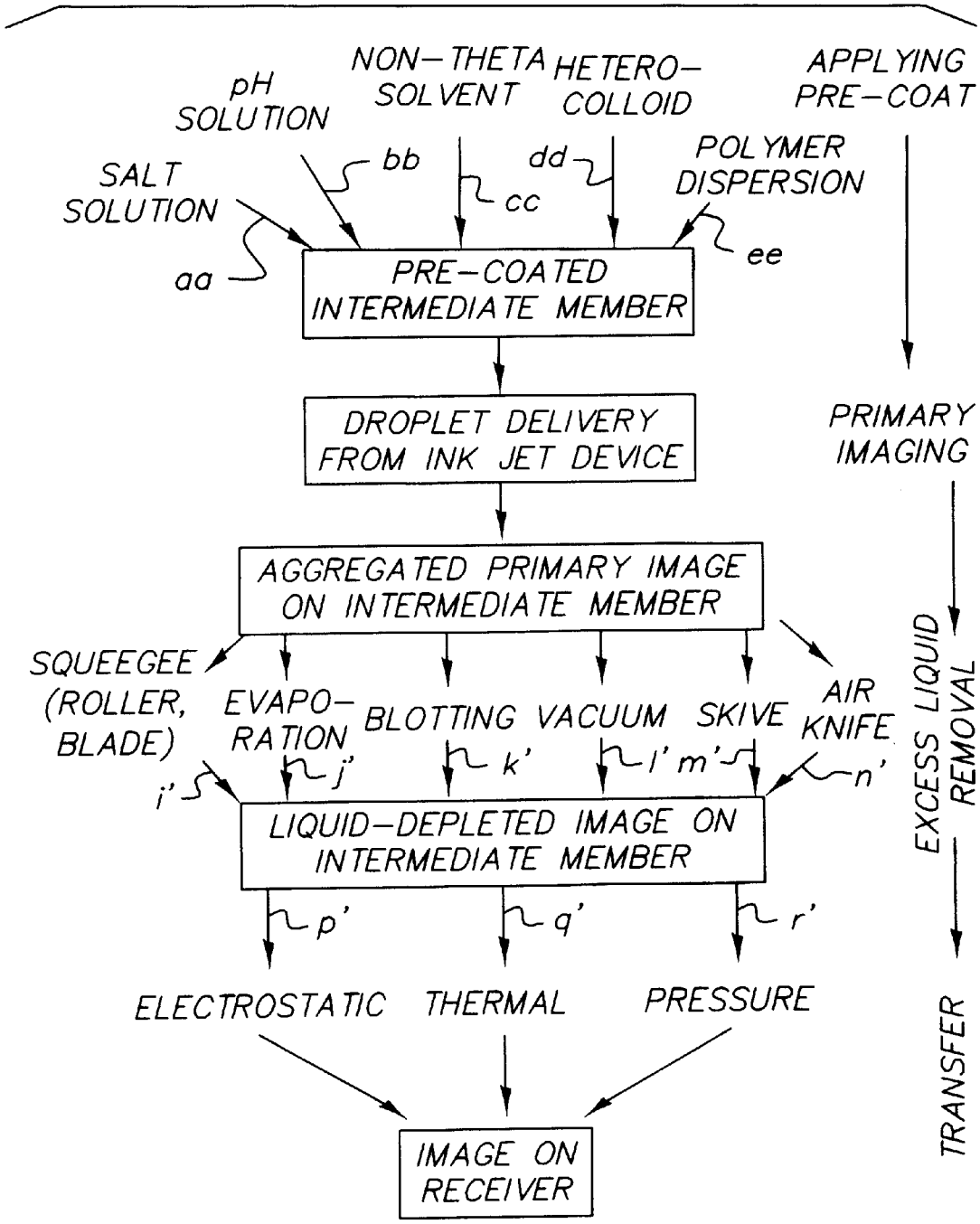
FIG. 5 is a flow chart illustrating another set of various pathways of steps for practicing the invention.

FIG. 5 is a similar flow chart, relating to portions of FIG. 3. Thus, starting at the top right of FIG. 5, the right hand column indicates passage from the Applicator Process Zone 20 through the ink jet device 11' and then through successive Process Zones 12', 13' and 14', i.e., successively forming a pre-coated intermediate member 16' by applying a pre-coat including a coagulation-inducing material or reagent, depositing a primary ink jet image via ink jet device 11', forming coagulates in the primary image, removing excess liquid, and transferring the liquid-depleted ink-jet-ink-derived image to a receiver. According to the invention, after a pre-coat is formed on the operational surface of intermediate member (IM) 16', there are various possible routes to reach the condition of a coagulated or aggregated image described herein above with reference to FIG. 1, which routes are indicated by the arrows labeled as aa, bb, cc, dd, and ee. These arrows indicate at least five different routes and any other suitable routes may be used. The arrows labeled as i', j', k', l', m', and n' indicate at least six different routes to proceed from a coagulated or aggregated image to a liquid-depleted or "dried" image on the intermediate member, and any other suitable routes may be used. Following formation of the "dried" image, the transfer routes for transfer to a receiver as described in detail above are symbolized by the three arrows labeled as l', m', and n', i.e., representing respectively electrostatic, thermal and pressure transfer (combinations of electrostatic, thermal and pressure mechanisms for transfer are implicitly included also). With reference also to FIG. 3, the flow chart of FIG. 5 shows possible routes from a pre-coated IM to an ink-jet-ink-derived material image on a receiver member, any one of which routes can be represented in brief as follows:

[(aa, bb, cc, dd, ee); (i', j', k', l', m', n'); (p', q', r')]

where it is to be understood that at least 5×6×3=90 possible routes are contemplated in FIG. 5, e.g., [aa; i'; p'], [aa; i'; q'], . . . , and so forth.

It will be understood that the invention is not limited to the various steps of the 162+90=252 possible routes depicted schematically in FIGS. 4 and 5; any set of process steps or mechanisms that produces, from a primary ink jet image on an IM, a liquid-depleted ink-jet-ink-derived material image on the IM for transfer to a receiver, is included in the invention. Any combination of two or more of such process steps may be used in conjunction or at the same time.

With further reference to FIG. 4, the process of forming an aggregated image in certain embodiments of the invention starts with use of an ink jet device such as device 11 in FIG. 2, and an aggregated image may be formed from a primary image via a number of alternative pathways indicated by arrows a, b, . . . , g, h, which pathways are described more fully in the immediately following paragraphs.

According to one alternative pathway indicated in FIG. 4 by the arrow labeled, a, the formation of coagulates may be induced, in a primary image made from an electrostatically stabilized aqueous-based particulate ink dispersion, by a Salt Effect, wherein a dissolved salt including a multivalent cation or anion is introduced into the carrier liquid of the primary image. In the Coagulate Formation Process Zone 12 of FIG. 2, such a coagulate-inducing salt solution is added to the primary image by an external salt donation mechanism, such as by a sponge wetted with the salt solution and included in a web (not shown) or a squeegee blade (not shown), which web or squeegee blade contacts the operational surface of intermediate member (IM) 16. Alternatively, a sponge roller (not shown) wetted with the salt solution may be used, which roller contacts the operational surface of IM 16. As another alternative salt donation mechanism, a spray device (not shown) may be used to deliver a very fine aerosol of salt solution to the operational surface of IM 16. As a most preferred alternative salt donation mechanism, a secondary ink jet device (not shown) is used to deposit on each imaging pixel of the primary image at least a critical amount of the salt solution including a variable number of droplets of the salt solution, which number is proportional to a quantity of ink jet ink previously deposited on the same pixel by the ink jet device 11, and which droplets of the salt solution are preferably smaller than the droplets 17. Preferably, the particles included in the electrostatically stabilized ink jet ink are negatively charged, and the salt solution preferably includes multivalent inorganic cations. Salts of divalent cations may include inorganic salts of $Mg^{+2}$, $Ca^{+2}$, $Mn^{+2}$, $Ni^{+2}$, $Co^{+2}$, $Cu^{+2}$, Zn , and so forth. It is especially preferred to use salts of trivalent cations, including inorganic salts of $Al^{+3}$, $Fe^{+3}$, $Ce^{+3}$, and so forth, or quadrivalent ions such as $Ce^{+4}$, $Zr^{+4}$, and so forth. Any soluble dissociable compound producing a multivalent positive ion may be used, which dissolved dissociable compound may have any suitable corresponding anion(s). The concentration of a dissolved salt required to induce formation of coagulates in any ink jet ink of the primary image is a concentration that equals or exceeds the well known critical coagulation concentration (c.c.c.). Examples of c.c.c. are tabulated by J. Th. G. Overbeek in *Colloidal Dispersions*, Special Publication No. 43, pp 1–22, (The Royal Society of Chemistry, 1982). Thus, for an inorganic salt containing $Mg^{+2}$, $Ca^{+2}$ or $Zn^{+2}$, a c.c.c. typically ranges between about 350 to 720 micromoles per liter, and for an inorganic salt containing $Al^{+3}$ or $Ce^{+3}$, a c.c.c. typically ranges between about 3 to 96 micromoles per liter. According to the well-known Schulze-Hardy rule, a c.c.c. for inorganic salts of tetravalent cations can be calculated to be about 20% lower than the above-quoted range of values for inorganic salts of trivalent anions. It follows that a salt solution for use in the salt donation mechanism, e.g., in a preferred secondary ink jet device, is required to have a concentration at least as high as the respective c.c.c., so that upon admixture of at least a critical amount of the salt solution with any drops of ink jet ink of the primary image, a liquid phase is produced in which the c.c.c. remains equaled or exceeded, thereby resulting in an aggregated image. Alternatively, when the particles of the electrostatically stabilized ink jet ink are positively charged, the salt donation mechanism is entirely similar to the above-described salt donation mechanism for use when the particles of the electrostatically stabilized ink jet ink are negatively charged, and a salt solution for use in the salt donation mechanism preferably includes multivalent inorganic anions. Salts of divalent anions may include $SO_4^{-2}$, $CO_3^{-2}$, and so forth. It is especially preferred to use salts of trivalent anions, including inorganic salts of $Fe(CN)_6^{-3}$, $PO_4^{-3}$, and so forth. Any soluble dissociable compound producing a multivalent negative ion may be used, which dissolved dissociable compound may have any suitable corresponding cation(s). As quoted by Overbeek in the above-cited article, a c.c.c. for an inorganic sulfate is typically about 200 micromoles per liter, and according to the well-known Schulze-Hardy rule, a c.c.c. of less than about 20 micromoles per liter may be calculated for inorganic salts of trivalent anions.

According to another alternative pathway to an aggregated image indicated in FIG. 4 by the arrow labeled, b, formation of coagulates may be induced, in a primary image made from an electrostatically stabilized aqueous-based particulate ink dispersion, by a pH Effect. As discussed for example by D. H. Everett, *Basic Principles of Colloid Science*, (The Royal Society of Chemistry, 1988), page 37, a negatively charged colloid may be produced by the dissociation of acidic moieties bound or adsorbed to the surface of the particles of the colloid, thereby producing $H^+$ ions in the liquid. Lowering the pH of the liquid by adding an acid will result in a reduced dissociation, and at a particular concentration of added acid, dissociation will be completely suppressed. This is known as the point of zero charge (pzc). Similarly, a positively charged colloid may be produced by the dissociation of basic moieties bound or adsorbed to the surface of the particles of the colloid, thereby producing $OH^+$ ions in the liquid. Raising the pH of the liquid by adding a base will result in a reduced dissociation, and at the pzc, dissociation will be completely suppressed. For an amphoteric colloid, the polarity of the particles can be reversed by passing through the pzc. According to the invention, a preferably non-amphoteric colloid is used for the ink jet ink, and a pH-altering agent is used to alter the pH so that the pzc, corresponding to a critical pH, is attained. The pH-altering agent includes any suitable material, e.g., an acidic solution or a basic solution, or alternatively which material is a precursor to an acidic or a basic solution when mixed with the ink jet ink included in a primary image. To form an aggregated primary image in the Coagulate Formation Process Zone 12 of FIG. 2, a pH-altering solution is added to the primary image by a pH-altering donation mechanism, such as by a sponge wetted with the pH-altering solution and included in a web (not shown) or a squeegee blade (not shown), which web or squeegee blade contacts the operational surface of intermediate member (IM) 16. Alternatively, a sponge roller (not shown) wetted with the pH-altering solution may be used, which roller contacts the operational surface of IM 16. As another alternative pH-altering donation mechanism, a spray device (not shown) may be used to deliver a very fine aerosol of pH-altering solution to the operational surface of IM 16. As a most preferred alternative pH-altering donation mechanism, a secondary ink jet device (not shown) is used to deposit on each pixel of the primary image at least a critical amount of the pH-altering solution including a variable number of droplets of the pH-altering solution, which number is preferably proportional to a quantity of ink jet ink previously deposited on the same pixel by the ink jet device 11, and which droplets of the pH-altering solution are preferably smaller than the droplets 17. For use with an electrostatically stabilized ink jet ink having negatively charged particles, the pH-altering solution is an acidic solution including any soluble dissociable acid. The concentration of the acidic solution provided by the pH-altering donation mechanism is such that, when at least a critical amount or more of the acidic solution is combined with any ink jet ink of the primary image, the resulting liquid has a pH that is everywhere equal to, or smaller than, the critical pH. It follows that an acidic solution, for use in the pH-altering donation mechanism, e.g., in a preferred secondary ink jet device, is required to have a hydrogen ion concentration at least as high as the hydrogen ion concentration corresponding to the critical pH, so that upon admixture of any critical amount or more of the acidic solution with any drops of ink jet ink of the primary image, a liquid phase is produced having a pH less than or equal to the critical pH, so that an aggregated image may spontaneously form on IM 16. Similarly, for use with an electrostatically stabilized ink jet ink having positively charged particles and $OH^-$ ions in the carrier solution, the pH-altering solution is a basic solution including any soluble dissociable base. A basic solution, for use in the pH-altering donation mechanism, e.g., in a preferred secondary ink jet device, is required to have a hydroxyl ion concentration at least as high as the hydroxyl ion concentration corresponding to the critical pH, so that upon admixture of any critical amount or more of the basic solution with any drops of ink jet ink of the primary image, a liquid phase is produced having a pH greater than or equal to the critical pH so that an aggregated image may spontaneously form on IM 16.

Figure 6:
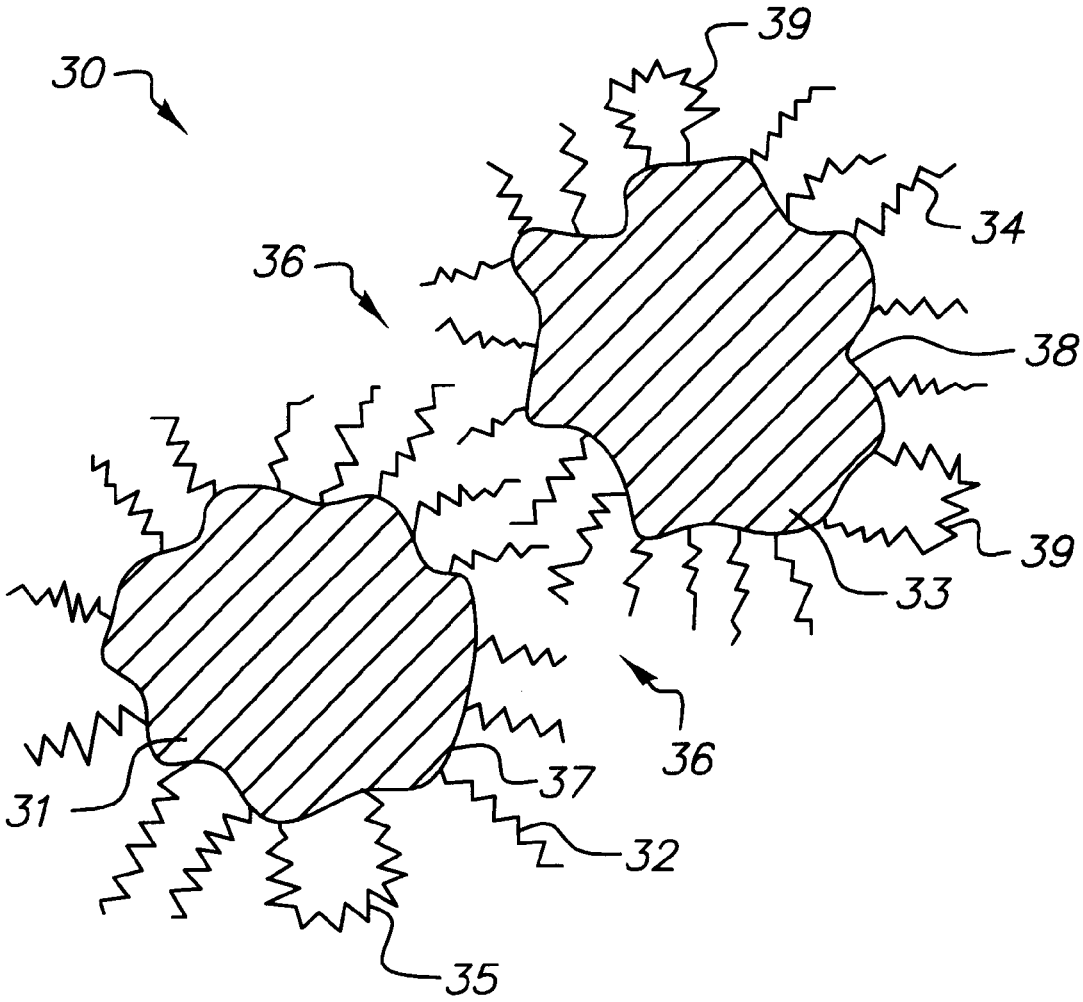
FIG. 6 schematically illustrates two proximate sterically stabilized colloidal particles in a primary ink jet image on an intermediate.

According to yet another alternative pathway to an aggregated image indicated in FIG. 4 by the arrow labeled, c, formation of coagulates may be induced, in a primary image made from a sterically stabilized particulate ink dispersion, by a Solvent Effect described for example by D. H. Napper in *Colloidal Dispersions*, Special Publication No. 43, pp 99–128, (The Royal Society of Chemistry, 1982). In FIG. 6 is sketched a sterically stabilized pair, indicated by the numeral 30, of proximate, similar, colloidal ink particles 31 and 33 suspended in a liquid or carrier fluid 36 (other similar particles of the ink are not shown). Particle 31 includes polymeric moieties, labeled as 32 and 35, which moieties are bonded or adsorbed to surface 37 of particle 31, and particle 33 includes polymeric moieties 34 bonded or adsorbed to surface 38. Moieties such as 32 and 34 are shown in the form of molecular chains each bonded at one end to surface 37, which molecular chains extend into liquid 36. Other moieties, such as 35 and 39 shown for simplicity as being bonded at both ends to surfaces 37 and 38 respectively, represent the more general case whereby a moiety may be attached by a plurality of bonding sites but still have extended chain portions which interact strongly or are solubilized by the liquid 36. The colloidal ink particles 31 and 33 are preferably included in a nonaqueous carrier liquid 36. Alternatively, liquid 36 may be an aqueous-based liquid. The extended conformations of the chains are formed spontaneously when liquid 36 is a so-called θ-solvent for the molecular portions included in the extended chain conformations of moieties 32, 34 and 35. As is well understood, the existence of these extended conformations provides steric stabilization by effectively preventing a close approach of particles 31 and 33, thereby preventing their mutual adhesion by attractive short range van der Waals or dispersion forces. By adding a critical amount of a non-solvent for the solution-embedded ends or regions of the sterically stabilizing polymeric moieties adsorbed to the colloid particle surfaces (i.e., adding a non-θ-solvent), these polymeric moieties change their configurational shapes from extended shapes, such as shown for moieties 32, 34, 35 and 39, and instead assume tight conformations (not illustrated). In these tight conformations, interactions with the non-solvent molecules of the liquid are minimized, allowing the van der Waals or dispersion forces to act so as to form flocs or coagulates. In effect, the combined fluid, containing both ink jet ink carrier liquid and the added non-θ-solvent, is also a non-θ-solvent. An added non-θ-solvent is miscible with liquid 36. To form an aggregated primary image in the Coagulate Formation Process Zone 12 of FIG. 2, a non-θ-solvent, which non-θ-solvent is miscible with the carrier liquid of a sterically stabilized colloidal ink jet ink 17, is introduced into the liquid of the primary image by an external non-solvent donation mechanism, such as by a sponge wetted with the non-θ-solvent and included in a web (not shown) or a squeegee blade (not shown), which web or squeegee blade contacts the operational surface of intermediate member (IM) 16. Alternatively, a sponge roller (not shown) wetted with the non-θ-solvent may be used, which roller contacts the operational surface of IM 16. As another alternative non-solvent donation mechanism, a spray device (not shown) may be used to deliver a very fine aerosol of non-θ-solvent to the operational surface of IM 16. As a most preferred alternative non-solvent donation mechanism, a secondary ink jet device (not shown) is used to deposit on each pixel of the primary image at least a critical amount of the non-θ-solvent including a variable number of droplets of the non-θ-solvent, which number is proportional to a quantity of ink jet ink previously deposited on the same pixel by the ink jet device 11, and which droplets of the non-θ-solvent are preferably smaller than the droplets 17. The non-solvent donation mechanism, e.g., a preferred secondary ink jet device, is required to deliver a critical amount or more of the non-θ-solvent, so that upon admixture of any delivered critical amount or more of the non-θ-solvent with any drops of ink jet ink of the primary image, a combination liquid phase is produced that is also a non-θ-solvent, in which combination liquid phase coagulates are spontaneously formed to give an aggregated image.

According to still yet another alternative pathway to an aggregated image indicated in FIG. 4 by the arrow labeled, d, formation of coagulates may be induced, in a primary image made from a colloidal particulate ink dispersion having steric stabilization, by any chemical or physical agent or mechanism for effectively denuding the particles, e.g., by destroying the stabilizer on the particles, or alternatively removing the stabilizer from the particles. With further reference to FIG. 6, such an agent or mechanism can cause a debonding or a desorption of the sterically stabilizing moieties such as 32, 34, 35 and 39, leaving each particle of the dispersion with a reduced number of such moieties remaining bonded to surfaces such as 37 and 38, which debonded or desorbed moieties (not illustrated) become dispersed in the carrier liquid 36. Following such a denuding, debonding, or desorption, particles such as 31 and 33 preferably retain only a few of the original numbers of stabilizing moieties, and more preferably, substantially none. Alternatively, the denuding agent mechanism causes most, if not substantially all, of the sterically stabilizing moieties such as 32, 34, 35 or 39 to be at least partially destroyed, such as by cleavage of chemical bonds of the polymeric moieties 32, 34, 35 or 39. Following such a destruction, the carrier liquid will contain molecular debris (not illustrated) formed, physically or chemically, from the destroyed or partially destroyed sterically stabilizing moieties, and the particles such as 31 and 33 may retain a number of truncated, attached chains (not illustrated) remaining from scissions of the original moieties such as 32, 34, 35 and 39. The resulting comparatively unshielded or denuded particles, no longer protected by steric stabilization, are subject to formation of coagulates as a result of their mutual attractions caused by van der Waals or dispersion forces between them. A rate of coagulate formation, modulated by random Brownian motion, can be calculated as discussed for example by D. H. Everett, *Basic Principles of Colloid Science*, (The Royal Society of Chemistry, 1988), cited earlier above. Thus the Brownian motion halflife for coagulate formation for a typical liquid colloid, containing for example 3% by volume of 100 nanometer diameter particles, is of the order of 30 milliseconds in water and 10 milliseconds in hexane, while for 10 nanometer diameter particles, the halflives are reduced by a factor of about 1000, i.e., to about 30 microseconds in water and 10 microseconds in hexane. Owing to the mutual attractions between the unshielded particles from the dispersion forces, the actual halflives will be somewhat shorter than the calculated Brownian motion halflives. To enhance the mutual interparticle attractions, it is preferred that the fluid 36 have a dielectric constant smaller than that of the particles 31 and 33. To form an aggregated primary image in the Coagulate Formation Process Zone 12 of FIG. 2, a denuding agent mechanism (not illustrated) results in a formation of coagulates, which denuding agent mechanism includes a source of radiation (not illustrated) directed towards the primary ink jet ink image on the intermediate member 16, which radiation may cause a debonding or desorption of sterically stabilizing moieties such as 32, 34, 35 and 39, e.g., by a heating of one or more of the components of the primary ink jet ink image, thereby producing partially or completely denuded particles. Alternatively, the source of radiation can be chosen to produce photochemical reactions involving any components of the primary ink jet image for photochemically cleaving or destroying the polymeric chains of the sterically stabilizing moieties, thereby producing partially or completely denuded particles. Any other suitable agent or mechanism may be used for removing, cleaving or destroying any sterically stabilizing moieties bonded to, or adhered to, the surfaces of the particles of a sterically stabilized ink jet ink, thereby causing a partial or complete denuding of the particles resulting in a spontaneous formation of coagulates in an aggregated image.

Formation of coagulates may be induced, in a primary image made from an aqueous-based or a nonaqueous colloidal particulate ink dispersion having steric stabilization, by a heating or a cooling which decreases the solvency, in carrier liquid 36, of the stabilizing moieties, e.g., polymeric chains such as 32, 34, 35 and 39. This is indicated in FIG. 4 as another alternative pathway to an aggregated image by the arrow labeled, e. As elucidated by D. H. Everett, *Basic Principles of Colloid Science*, (The Royal Society of Chemistry, 1988), the effect of heating or cooling is determined by the relative magnitudes of the enthalpy and entropy contributions to the free energy of close approach of sterically stabilized particles. In a stable ambient condition (free energy is positive) such that the enthalpy term dominates (enthalpic stabilization) flocculation of a sterically stabilized dispersion may be produced by a heating which increases the entropic contribution (thereby making the free energy negative). Conversely, in a stable ambient condition such that the entropy term dominates (entropic stabilization) flocculation may be produced by a cooling. Entropic stabilization is more common for nonaqueous dispersions, while enthalpic stabilization may be more common for aqueous-based dispersions. In the Coagulate Formation Process Zone 12 of FIG. 2, an aggregated primary image is formed by a temperature-altering mechanism for changing the temperature of ink droplets 17 after the ink droplets have formed a primary ink jet ink image on intermediate member 16.

In one embodiment using the temperature-altering mechanism, a heating mechanism (not illustrated) is used for heating the primary ink jet ink image to form coagulates in the primary image. The heating mechanism for producing an aggregated image includes a source of radiant energy, e.g., infrared radiation, which radiant energy is directed towards the primary image and is absorbable by the surface material of intermediate member 16, or is absorbable by one or more of the components of the ink jet ink image and preferably by the carrier liquid, or is absorbable by both. The heating mechanism may alternatively be a source of heat (not illustrated) located within intermediate member 16, or, the heating mechanism may alternatively be an external heated member, such as a roller (not illustrated). The heated member may be separated by a small gap from the primary image, or the heated member may be used for contacting the intermediate member 16 and providing heat, preferably at but not limited to a location between Regeneration Process Zone 15 and ink jet device 11. Preferably, the heating mechanism is for use with an aqueous-based ink jet ink 17, although in certain applications a nonaqueous ink may be employed.

In an alternative embodiment using the temperature-altering mechanism, a cooling mechanism (not illustrated) may be used for cooling the primary ink jet ink image to form coagulates in the primary image. Preferably, the cooling mechanism is for use with a nonaqueous ink jet ink 17, although in certain applications an aqueous-based ink may be employed. The cooling mechanism for producing an aggregated image is located within intermediate member 16, and includes a Peltier effect cooling device, a coolant circulated in conduits of a coolant circulating system, or any other suitable internally-located cooling mechanism. Alternatively, the cooling mechanism is located external to intermediate member 16 and includes a Peltier effect cooling device, a coolant circulated in conduits of a coolant circulating system, or any other suitable external cooling mechanism. The external cooling mechanism (not illustrated) may be separated from the primary image by a gap, or, the external cooling mechanism may be included in a roller or other suitable member contacting intermediate member 16, preferably at but not limited to a location between Regeneration Process Zone 15 and ink jet device 11.

According to another alternative pathway to an aggregated image indicated in FIG. 4 by the arrow labeled, f, formation of coagulates in a colloidal ink jet ink dispersion of a primary image may be accomplished to form an aggregated image by an addition of a hetero-colloid dispersed in a carrier fluid. A hetero-colloid is defined as any suitable colloidal dispersion having charged particles of a polarity opposite to the polarity of the particles of the ink jet ink dispersion. Electrostatic attractions between the oppositely charged particles in the resulting mixture of dispersions cause hetero-coagulates to be formed. Preferably, the carrier fluids of the two dispersions are mutually miscible. It is further preferred that the particles of the added non-ink dispersion do not significantly dilute the color intensity of the hetero-coagulate, nor significantly affect the color due to that portion of the coagulate formed from the ink jet ink. In certain circumstances, some or all of the particles of the hetero-colloid may have a color which is the same as, or similar to, the color of the ink particles. The particulate material of the added dispersion preferably provides any useful function, such as for example enhancing the transferability of the hetero-coagulates to a receiver, or improving in a fusing station the fusibility of an image including hetero-coagulates previously transferred to a receiver. To form an aggregated primary image in the Coagulate Formation Process Zone 12 of FIG. 2, a hetero-colloidal dispersion having charged particles of opposite polarity to the particles of the ink jet ink dispersion is introduced into the liquid of the primary image by an external hetero-colloid-depositing agent or hetero-colloid donation mechanism, such as by a sponge wetted with the hetero-colloidal dispersion and included in a web (not shown) or a squeegee blade (not shown), which web or squeegee blade contacts the operational surface of intermediate member (IM) 16. Alternatively, a sponge roller (not shown) wetted with the hetero-colloidal dispersion may be used, which roller contacts the operational surface of IM 16. As another alternative hetero-colloid donation mechanism, a spray device (not shown) may be used to deliver a very fine aerosol of the hetero-colloidal dispersion to the operational surface of IM 16. As a most preferred alternative hetero-colloid donation mechanism, a secondary ink jet device (not shown) is used to deposit on each pixel of the primary image a critical amount or more of the hetero-colloidal dispersion including a variable number of droplets of the hetero-colloidal dispersion, which number is proportional to a quantity of ink jet ink previously deposited on the same pixel by the ink jet device 11, and which droplets of the hetero-colloidal dispersion are preferably smaller than the droplets 17. The hetero-colloid donation mechanism, e.g., a preferred secondary ink jet device, is required to deliver a critical amount or more of the hetero-colloidal dispersion, so that upon admixture of the any delivered critical amount or more of the hetero-colloidal dispersion with any drops of ink jet ink of the primary image, a hetero-coagulate aggregate image is produced.

According to yet another alternative pathway to an aggregated image indicated in FIG. 4 by the arrow labeled, g, formation of coagulates in a primary image made from an aqueous-based colloidal particulate ink dispersion may be induced to form an aggregated image by utilizing an electrocoagulation technique, such as disclosed in the Castegnier et al. patents cited above in the section pertaining to the background of the invention. In the subject invention, electrocoagulation of an ink jet ink primary image on an intermediate member is very different from imagewise electrocoagulation of a liquid layer on a receiver member, as described in the Castegnier et al. patents. To form an aggregated primary image in the Coagulate Formation Process Zone 12 of FIG. 2, an electrocoagulation member of an electrocoagulation member mechanism (not illustrated) is disposed in proximity to and facing the intermediate member, which electrocoagulation member includes an electrode, the electrocoagulation member being separated from the surface of intermediate member 16 by a small gap. This gap has uniformly the same size in a direction across the width of the operational surface of intermediate member 16, i.e., in a direction parallel to the axis of shaft 21. The size of the gap lies in a range of approximately between 5 micrometers and 100 micrometers. Generally speaking, the size of the gap is sufficiently small so that any liquid-containing portions of the primary image are contacted, and so the higher the image resolution (dpi) the smaller the gap. Alternatively, the electrocoagulation member is in contact with the primary image on the operational surface of the intermediate member. An electrocoagulation member in contact with the primary image on the intermediate member is preferably a rotatable member, e.g., a roller or a web. The surface of the electrode of the electrocoagulation member facing the intermediate member 16 is preferably disposed parallel to the outer surface of the electrocoagulation member facing the intermediate member, which electrode is connected to a source of both voltage and current. The electrode of the electrocoagulation member may be a bare electrode or it may be covered by one or more layers. The intermediate member 16 for use in electrocoagulation includes a sub-surface electrode (not shown in FIG. 2) as described more fully below in reference to FIG. 8. It is preferred that the subsurface electrode of intermediate member 16 is positive with respect to the electrode of the electrocoagulation member, which sub-surface electrode is preferably grounded. Alternatively, the sub-surface electrode is positive and is connected to a source of both voltage and current while the electrode of the electrocoagulation member may be grounded or biased negatively. Each of any of the layers disposed on the sub-surface electrode and each of any of the layers disposed on the electrode of the electrocoagulation member preferably has a resistivity of less than $10^4$ ohm-cm, and more preferably, less than $5\times10^2$ ohm-cm. Any suitable electrocoagulable ink may be used. Such a coagulable ink may form coagulates of any preselected color. Coagulates, produced by the passage of electrical current through the liquid included in the primary image on the operational surface of intermediate member 16, spontaneously form a coagulated layer in direct contact with the operational surface, i.e., located below a residual layer of excess liquid including liquid exhausted of electrocoagulable components, thereby resulting in an aggregated image.

According to even yet another alternative pathway to an aggregated image indicated in FIG. 4 by the arrow, h, an addition of a polymeric material can induce the formation of flocs (or coagulates) to form an aggregated image from a colloidal ink jet ink primary image on an intermediate member. As described by D. H. Everett, *Basic Principles of Colloid Science*, (The Royal Society of Chemistry, 1988), this process is called depletion flocculation. The polymeric material is preferably dispersed as a colloid in a fluid or else dissolved in a fluid, which polymeric material is not adsorbed by the colloidal ink particles. The fluid is preferably miscible with the carrier liquid of the colloidal ink jet ink. Any suitable polymeric material may be used, and the carrier liquid of the colloidal ink jet ink is preferably aqueous-based and the ink jet dispersion electrostatically stabilized. Alternatively, the ink jet dispersion may be non-aqueous. To form an aggregated primary image induced by a depletion flocculation in the Coagulate Formation Process Zone 12 of FIG. 2, a polymer-containing liquid including a polymeric material which is not adsorbed by the colloidal ink particles of the ink jet ink dispersion is introduced into the liquid of the primary image by a polymer-solution-donation mechanism, such as by a sponge wetted with the polymer-containing liquid and included in a web (not shown) or a squeegee blade (not shown), which web or squeegee blade contacts the operational surface of intermediate member (IM) 16. Alternatively, a sponge roller (not shown) wetted with the polymer-containing liquid may be used, which roller contacts the operational surface of IM 16. As another alternative polymer-donation mechanism, a spray device (not shown) may be used to deliver a very fine aerosol of the polymer-containing liquid to the operational surface of IM 16. As a most preferred alternative polymer-donation mechanism, a secondary ink jet device (not shown) is used to deposit on each pixel of the primary image a critical amount or more of the polymer-containing liquid including a variable number of droplets of the polymer-containing liquid, which number is proportional to a quantity of ink jet ink previously deposited on the same pixel by the ink jet device 11, and which droplets of the polymer-containing liquid are preferably smaller than the droplets 17. The polymer-donation mechanism, e.g., a preferred secondary ink jet device, is required to deliver a critical amount or more of the polymer-containing liquid, so that upon admixture of any delivered critical amount or more of the polymer-containing liquid with any drops of ink jet ink of the primary image, a flocculate or a coagulate is produced, thereby forming an aggregated image.

According to certain other embodiments of the invention, an aggregated image is formed via a number of other alternative pathways to be described with reference to FIG. 5, which shows these pathways starting with an applicator mechanism for applying a pre-coat, e.g., for use in an Applicator Process Zone 20 in FIG. 3. Such applicator mechanisms for use in forming a pre-coated intermediate member are indicated in FIG. 5 by arrows, aa, bb, cc, dd, and ee, and it is to be understood that the invention is not limited to these mechanisms.

In one alternate pathway to a pre-coated intermediate member, corresponding to arrow aa of FIG. 5, a salt solution containing a multivalent cation or anion is applied as a pre-coat to the operational surface of the intermediate member 16' shown in FIG. 3. This multivalent salt solution is entirely similar to any of the salt solutions described above in reference to FIG. 4. The multivalent salt solution may be applied in Applicator Process Zone 20 in FIG. 3 by any suitable mechanism of application (not illustrated) including a metering device, a doctor blade, a brush, a sponge, a sprayer, a supplementary ink jet type of device, and so forth, which mechanism of application may include a rotatable member. A smoothing device (not illustrated) for smoothing the applied multivalent salt solution pre-coat, such as a skive or blade, may also be employed. Preferably, a uniformly thick multivalent salt solution pre-coat is applied to the operational surface. Alternatively, a multivalent salt solution pre-coat having a variable thickness may be applied, or alternatively a multivalent salt solution pre-coat is selectively applied in differing amounts at different locations on the operational surface, e.g., by a supplementary ink jet type of device (not illustrated). As another alternative, any multivalent salt of the type described above in reference to FIG. 4 may be used, which multivalent salt is preferably highly soluble in the carrier liquid of an ink jet ink 17', which multivalent salt may be included in a pre-coat, e.g., as a powder in dry crystalline form including said multivalent salt, or as a thin layer of a concentrated aqueous-based paste or slurry, and such powder, paste or slurry may be applied to the operational surface by any suitable mechanism. A multivalent salt powder, e.g., in the form of dry crystals, preferably has a very small particle size or is finely ground so as to be rapidly dissolvable in the liquid of the ink jet ink primary image. Such a powder may be applied electrostatically, triboelectrically, or by any suitable process, method or device. Any component included in a paste or a slurry is preferably soluble in or miscible with the liquid of the ink jet ink primary image. After the multivalent salt pre-coat is applied, an ink jet ink primary image is formed by ink jet device 11' on the pre-coated intermediate member 16', which ink jet ink 17' is preferably an aqueous-based, electrostatically stabilized, colloidal dispersion of pigmented particles. Alternatively, any suitable ink jet ink 17' may be used.

In another alternate pathway to a pre-coated intermediate member, corresponding to arrow bb of FIG. 5, a pH-altering solution containing for example an acid or a base is applied as a pH-altering pre-coat to the operational surface of the intermediate member 16' shown in FIG. 3. The ph-altering solution is entirely similar to any of the pH-altering solutions described above in reference to FIG. 4. The ph-altering solution may be applied in Applicator Process Zone 20 in FIG. 3 by any suitable mechanism of application (not illustrated) including a metering device, a doctor blade, a brush, a sponge, a sprayer, a supplementary ink jet type of device, and so forth, which mechanism of application may include a rotatable member. A smoothing device (not illustrated) for smoothing the applied pH-altering pre-coat, such as a skive or blade, may also be employed. Preferably, a uniformly thick pH-altering pre-coat is applied to the operational surface. Alternatively, a pH-altering pre-coat having a variable thickness may be applied, or alternatively a pH-altering pre-coat is selectively applied in differing amounts at different locations on the operational surface, e.g., by a supplementary ink jet type of device (not illustrated). As another alternative, any ph-altering material of the type described above in reference to FIG. 4 may be used, which pH-altering material is preferably highly soluble in the carrier liquid of an ink jet ink 17', which pH-altering material may be included in a pH-altering pre-coat, e.g., in dry crystalline form, or which pH-altering material may be included in a thin layer of a concentrated aqueous-based paste or slurry, and which pre-coat may be applied to the operational surface by any suitable mechanism. When applied as dry crystals, the pH-altering crystals are preferably of very small size or are finely ground so as to be rapidly dissolvable in the liquid of the ink jet ink primary image. Any component included in a paste or a slurry is preferably soluble in or miscible with the liquid of the ink jet ink primary image. After the pH-altering pre-coat is applied, an ink jet ink primary image is formed by ink jet device 11' on the pre-coated intermediate member 16', which ink jet ink 17' is preferably an aqueous-based and electrostatically stabilized colloidal dispersion of pigmented particles. Alternatively, any suitable ink jet ink 17' may be used.

In yet another alternate pathway to a pre-coated intermediate member, corresponding to arrow cc of FIG. 5, any non-θ-solvent of the type described above with reference to FIG. 4 is applied as a solubilization-altering solvent pre-coat to the operational surface of the intermediate member 16' shown in FIG. 3. The solubilization-altering solvent is entirely similar to any of the solubilization-altering non-θ-solvents described above in reference to FIG. 4, which non-θ-solvents have the ability to desolubilize sterically stabilizing moieties bound or adsorbed to the particles of an ink jet ink. The solubilization-altering solvent may be applied in Applicator Process Zone 20 in FIG. 3 by any suitable mechanism of application (not illustrated) including a metering device, a doctor blade, a brush, a sponge, a sprayer, a supplementary ink jet type of device, and so forth, which mechanism of application may include a rotatable member. A smoothing device (not illustrated) for smoothing the applied solubilization-altering solvent pre-coat, such as a skive or blade, may also be employed. Preferably, a uniformly thick solubilization-altering solvent pre-coat is applied to the operational surface. Alternatively, a solubilization-altering solvent pre-coat having a variable thickness may be applied, or alternatively a solubilization-altering solvent pre-coat is selectively applied in differing amounts at different locations on the operational surface, e.g., by a supplementary ink jet type of device (not illustrated). After the solubilization-altering solvent pre-coat is applied, an ink jet ink primary image is formed by ink jet device 11' on the pre-coated intermediate member 16', which ink jet ink 17' is preferably a nonaqueous, sterically stabilized colloidal dispersion of pigmented particles. Alternatively, any suitable ink jet ink 17' may be used.

In still yet another alternate pathway to a pre-coated intermediate member, corresponding to arrow dd of FIG. 5, any hetero-colloid dispersion of the type described above with reference to FIG. 4 is applied as a hetero-coagulate-inducing pre-coat to the operational surface of the intermediate member 16' shown in FIG. 3. The hetero-coagulate-inducing hetero-colloid dispersion is entirely similar to any of the hetero-colloid dispersions described above in reference to FIG. 4, which hetero-colloid dispersions have the ability to form hetero-coagulates in a primary image. The hetero-colloid dispersion may be applied in Applicator Process Zone 20 in FIG. 3 by any suitable mechanism of application (not illustrated) including a metering device, a doctor blade, a brush, a sponge, a sprayer, a supplementary ink jet type of device, and so forth, which mechanism of application may include a rotatable member. A smoothing device (not illustrated) for smoothing the applied hetero-colloid dispersion pre-coat, such as a skive or blade, may also be employed. Preferably, a uniformly thick hetero-colloid dispersion pre-coat is applied to the operational surface. Alternatively, a hetero-colloid dispersion pre-coat having a variable thickness may be applied, or alternatively a hetero-colloid dispersion pre-coat is selectively applied in differing amounts at different locations on the operational surface, e.g., by a supplementary ink jet type of device (not illustrated). After the hetero-colloid dispersion pre-coat is applied, an ink jet ink primary image is formed by ink jet device 11' on the pre-coated intermediate member 16', which ink jet ink 17' includes any suitable aqueous-based or nonaqueous colloidal dispersions, which dispersions may be sterically stabilized, or electrostatically stabilized, or may have a combined steric and electrostatic stabilization.

In even yet another alternate pathway to a pre-coated intermediate member, corresponding to arrow ee of FIG. 5, any suitable polymeric dispersion or solution of the type described above with reference to FIG. 4 is applied as a depletion-flocculation-inducing pre-coat to the operational surface of the intermediate member 16' shown in FIG. 3. The depletion-flocculation-inducing polymeric dispersion or solution is entirely similar to any of the polymeric dispersions or solutions described above in reference to FIG. 4, which polymeric dispersions or solutions have the ability to destabilize a primary ink jet ink image. The polymeric dispersion or solution may be applied in Applicator Process Zone 20 in FIG. 3 by any suitable mechanism of application (not illustrated) including a metering device, a doctor blade, a brush, a sponge, a sprayer, a supplementary ink jet type of device, and so forth, which mechanism of application may include a rotatable member. A smoothing device (not illustrated) for smoothing the applied polymeric dispersion or solution pre-coat, such as a skive or blade, may also be employed. Preferably, a uniformly thick polymeric dispersion or solution pre-coat is applied to the operational surface. Alternatively, a polymeric dispersion or solution pre-coat having a variable thickness may be applied, or alternatively a polymeric dispersion or solution pre-coat is selectively applied in differing amounts at different locations on the operational surface, e.g., by a supplementary ink jet type of device (not illustrated). After the polymeric dispersion or solution pre-coat is applied, an ink jet ink primary image is formed by ink jet device 11' on the pre-coated intermediate member 16', which ink jet ink 17' is preferably an aqueous-based, electrostatically stabilized colloidal dispersion of pigmented particles. Alternatively, any suitable ink jet ink 17' may be used.

With reference to each of the pre-coating agents or mechanisms represented in FIG. 5 by arrows aa, bb, cc, dd, and ee, the corresponding passage of a primary image through the Coagulation Process Zone 12' in FIG. 3 does not necessarily imply or require that an external coagulate-inducing agent or external coagulate-inducing device be actually used in Zone 12'. Thus, the presence of a pre-coat, as priorly applied in Applicator Process Zone 20, is generally sufficient to cause a spontaneous formation of coagulates in the primary image formed by ink jet device 11'. However, a coagulate-inducing function of a pre-coat may be triggered, enhanced or accelerated by an ambient condition or by an alteration of an ambient condition, or by any optional external process or device for use in Coagulation Process Zone 12'. Such an optional process or device includes for example any suitable mechanism for a heating or a cooling of the primary image, a mechanism for radiating the primary image using a radiation source, a mechanism for applying an electric field to the primary image, or any other suitable process or device that may be used to trigger, enhance or accelerate the pre-coat-induced coagulate formation in Coagulation Process Zone 12'. It will be understood that any such ambient condition, process or device, operating or used by itself alone, is generally incapable of producing coagulates or forming coagulates rapidly enough, e.g., within an interval of time required for a location on the operational surface of intermediate member 16' to move from ink jet device 11' to Excess Liquid Removal Process Zone 13'.

Returning to FIG. 4, a liquid-depleted image may be formed on an intermediate member from an aggregated image by one of a number of alternative pathways including pathways indicated by the arrows, i, j, k, l, m, and n, which aggregated image was formed by one of the pathways a, b, g, h, as described above. Similarly, referring to FIG. 5, a liquid-depleted image may be formed on an intermediate member from an aggregated image by one of a number of alternative pathways including pathways indicated by the arrows i', j', k', l', m', and n', which aggregated image was formed by one of the alternative pathways indicated by the arrows aa, bb, cc, dd, and ee, as described above. Primed (') arrows in FIG. 5 and the corresponding unprimed arrows in FIG. 4, e.g., arrows i and i', refer respectively to entirely similar mechanisms or processes for creating a liquid-depleted image from an aggregated image. Consequently, each corresponding pair of primed and unprimed alternative pathways are given a shared description below.

In an alternative pathway such as indicated by the arrows i and i' for forming a liquid-depleted image on an intermediate member, a device such as a squeegee roller or squeegee blade may be used to remove excess liquid from the coagulates of an aggregated image in an Excess Liquid Removal Process Zone, e.g., Zone 13, 13' of FIGS. 2 and 3 (squeegee roller or squeegee blade not illustrated). A squeegee roller or squeegee blade device is useful particularly if the coagulates carry an electrostatic charge, whereupon an electric field applied between the respective roller or blade and respective intermediate member 16 or 16' can be used to urge such charged coagulates to migrate and preferably adhere to the operational surface of the respective intermediate member, thereby facilitating removal of the excess liquid by the respective squeegee roller or squeegee blade.

A concentrating of coagulate particles by means of an applied electric field is, however, useful only if the coagulates are, in fact, electrostatically charged, which may rarely be the case following any of the coagulate-inducing agents or mechanisms described above. Electrodes and biased elements that may be included in the Excess Liquid Removal Process Zones 13, 13' of the subject invention to provide an applied electric field for concentrating electrostatically charged coagulates on the surface of an intermediate member are disclosed in related U.S. patent application Ser. No. 09/973239 filed on even date herewith in the names of T. N. Tombs, J. W. May and A. Chowdry (Docket 81,459/LPK) and entitled Ink Jet Process Including Removal Of Excess Liquid From An Intermediate Member, the contents of which are incorporated herein by reference.

In another alternative pathway for forming a liquid-depleted image on an intermediate member, as indicated by the arrows j, j' in FIGS. 4 and 5 respectively, excess liquid is evaporated from an aggregated image by an evaporation device. Evaporation of excess liquid may be accomplished by a heating, such as by providing an internal source of heat in intermediate member 16, 16' (not illustrated), and it is clear that such an internal heating device may obviate the need for a localized heating apparatus situated between Coagulate Formation Process Zone 12, 12' and Transfer Process Zone 14, 14', respectively. Alternatively, intermediate member 16, 16' may be heated by contact with an external member (not illustrated) such as a heating roller. As another alternative, Excess Liquid Removal Process Zone 13, 13' may include any source of radiation, including radiation from a heated external member, which radiation is absorbable by intermediate member 16, 16', or by any component of the ink of the aggregated image, or by both. Evaporation of excess liquid may also be provided by an airflow, which airflow is provided, e.g., by a fan (not illustrated) or by a non-contacting vacuum device (not illustrated) located in the vicinity of the primary image, or preferably by a combination of heating and airflow. Preferably the airflow does not blur the aggregated image prior to or during the evaporation process.

In yet another alternative pathway for forming a liquid-depleted image from an aggregated image, as indicated by the arrows k, k' in FIGS. 4 and 5 respectively, excess liquid is removed from an aggregated image in the Excess Liquid Removal Process Zone 13, 13' (FIGS. 2, 3) by a blotting mechanism such as for example an external blotting, or liquid-absorbing, auxiliary rotatable member (not illustrated in FIGS. 2, 3). The auxiliary rotatable member is preferably in the form of a roller having an operational surface contacting the aggregated image in Zone 13, 13', wherein excess liquid of the aggregated image is absorbed or blotted by the auxiliary rotatable member, thereby producing a liquid-depleted image on intermediate member 16, 16'. The auxiliary rotatable member includes a preferably conformable, absorbent, blotting layer which may include an open cell foam or be otherwise porous in order for capillary forces to draw liquid into the interior of the blotting layer. It is also preferred that the operational surface and the interior surface area of a porous layer of the auxiliary rotatable member are wettable by the carrier liquid included in ink 17, 17". During contact of the external blotting member with the intermediate member, excess liquid is absorbed by the auxiliary rotatable member while the blotting layer is being gently squeezed. The term "gently squeezed" refers to a relatively small deformation of the preferably conformable blotting layer, which small deformation does not substantially affect an ability of the blotting layer to absorb carrier liquid. It is preferred that substantially none of the ink-jet-ink-derived coagulates of the aggregated image adhere to the operational surface of the auxiliary rotatable member, substantially all of the coagulates remaining on intermediate member 16, 16'. In order to restore absorbency to the auxiliary rotatable member, a blade (not illustrated) pressing against the auxiliary rotatable member may be used to squeeze liquid from the auxiliary rotatable member, the liquid being captured for example in a vessel (not illustrated) from whence the liquid may be recycled. Alternatively, a squeeze roller, preferably hard and impermeable, may be pressed against the auxiliary rotatable member, thereby squeezing out most of the liquid absorbed in the Excess Liquid Removal Process Zone 13, 13', which liquid may be captured, e.g., in a vessel (not illustrated).

In still yet another alternative pathway for forming a liquid-depleted image from an aggregated image on an intermediate member, as indicated by the arrows 1, 1' in FIGS. 4 and 5 respectively, excess liquid is removed from an aggregated image in the Excess Liquid Removal Process Zone 13, 13' (FIGS. 2, 3) by a vacuum mechanism (not shown) operated intermittently and located within the intermediate member (IM) 16, 16'. The intermittent vacuum mechanism may be used to suck the liquid phase of the aggregated image through a porous surface layer or layers into an interior chamber of intermediate member 16, 16', which liquid component is carried out of the interior chamber (for possible recycling) through any suitable vent, e.g., through a hollow shaft 21, 21' having the form of a pipe connecting the vacuum mechanism to the interior chamber. In this embodiment, the ink jet device 11, 11' and the vacuum mechanism are not operated simultaneously but intermittently, such that when a primary image is being formed by the ink jet device the vacuum mechanism is deactivated; in this embodiment, the vacuum mechanism is activated only when an aggregated image is within the Excess Liquid Removal Process Zone 13, 13'. This embodiment, although having an image-forming productivity reduced by a fractional duty cycle, may nevertheless be useful in certain applications. In an alternative embodiment, a similar vacuum mechanism may be located in the interior of an external auxiliary roller (not illustrated) which contacts intermediate member 16, 16' in the Excess Liquid Removal Process Zone 13, 13', which vacuum mechanism operates continuously to suck away excess liquid from successive aggregated image. In this alternative embodiment, which has a greater image-forming productivity, any coagulates formed in Zone 12, 12' are adhered preferentially to the operational surface of intermediate member 16, 16' and are repelled by the contacting surface of the auxiliary roller, by providing intermediate member 16, 16' and the auxiliary roller with suitable respective surface characteristics.

In still yet other alternative pathway for forming a liquid-depleted image from an aggregated image on an intermediate member, as indicated by the arrows m, m' in FIGS. 4 and 5 respectively, excess liquid is removed from an aggregated image in the Excess Liquid Removal Process Zone 13, 13'

(FIGS. 2, 3) by a skiving mechanism (not illustrated), which skiving mechanism includes a non-contacting blade for skimming off the excess liquid, thereby leaving a thin layer of residual liquid included in the liquid-depleted image so formed. The skiving mechanism may include a spongy or absorbent layer and may be electrically biasable by a power supply for urging coagulates towards the operational surface of intermediate member 16, 16'.

In a further alternative pathway for forming a liquid-depleted image on an intermediate member, as indicated by the arrows n, n' in FIGS. 4 and 5 respectively, excess liquid is removed from an aggregated image in the Excess Liquid Removal Process Zone 13, 13' (FIGS. 2, 3) by an air knife mechanism (not illustrated), which air knife mechanism provides a jet of air, emerging from a slit which runs across the width of the operational surfaces of intermediate member 16, 16' parallel to the axes of shafts 21, 21'. In this embodiment, the jet of air is typically directed at a low angle so as to blow excess liquid towards a location where an external vacuum device (not illustrated) can suck the excess liquid away from the surface so as to create a liquid-depleted or "dried" image on the intermediate member 16, 16'. This embodiment is practical if the coagulates of the aggregated image can become firmly adhered to the operational surface of the intermediate member before the air knife mechanism acts, e.g., by the action of an applied field or by any other force for urging the coagulates to come into adhering contact with the operational surface.

Transfer of an ink-jet-ink-derived, liquid-depleted image to a receiver, as respectively indicated in FIGS. 4, 5 by arrows p, p' and q, q' and r, r' for electrostatic transfer, thermal transfer and pressure transfer, has been described hereinabove in relation to the Transfer Process Zone 14, 14' of FIGS. 2, 3. For ease of discussion, electrostatic transfer, thermal transfer and pressure transfer have been indicated as distinctly separate pathways, but any combination of electrostatic transfer, thermal transfer and pressure transfer may be used such as may be required or useful in the practice of the invention.

Figure 7:
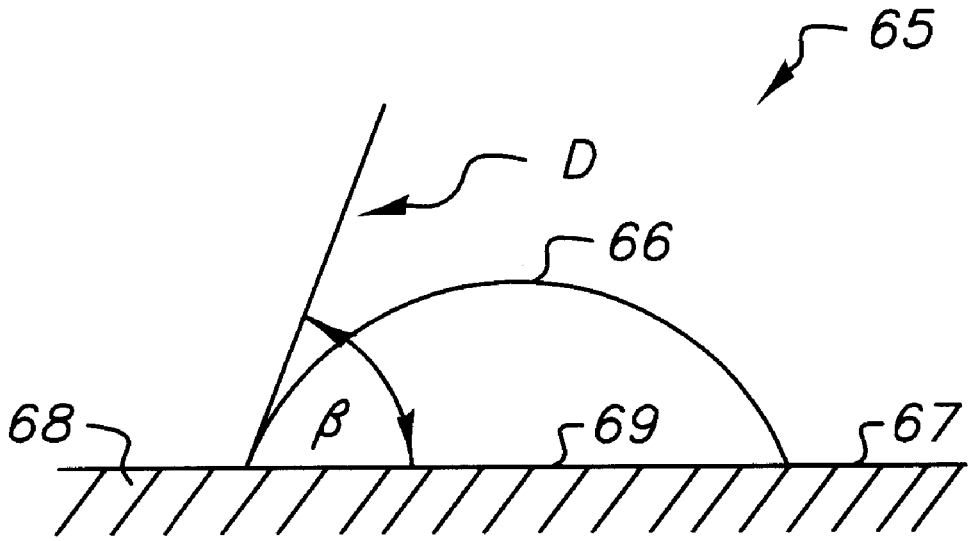
FIG. 7 schematically illustrates an as-deposited drop of ink jet ink on an intermediate member operational surface.

FIG. 7 shows a sketch of an approximately pixel-sized portion, indicated by the numeral 65, of an as-deposited primary image which includes a drop 66 formed by one or more ink droplets delivered from an ink jet device on to surface 67 of an intermediate member 68. The drop 66 has a liquid/air interface 66*a*, and an interfacial area 69 where the drop rests on the substrate. A spreading coefficient, SC, defined as the negative derivative of the free energy with respect to area 69, is given by a well-known equation:

$$SC=\gamma^{SV}-\gamma^{SL}-\gamma^{LV}.\cos\beta$$

where $\gamma^{SV}$, $\gamma^{SL}$, and $\gamma^{LV}$ are, respectively, surface free energies per unit area of the substrate/air interface (surface 67), the surface/liquid interface (surface 69) and the liquid/air interface (surface 66*a*), with angle β determined by a line labeled D drawn tangent to surface 66*a* at a point of intersection of surface 66*a* and interface 69. If SC is positive, drop 66 will tend to spread spontaneously, thereby reducing angle β and increasing area 69, which may result in an undesirable blurring of a primary image. If SC is negative, the reverse is true, and area 69 will tend to shrink. A large shrinkage of area 69 may cause an undesirable balling up of drop 66. It is preferred, therefore, that at a time which is substantially the time at which drop 66 is formed by an ink jet device, SC is zero. This is accomplished by an appropriate choice of materials for the carrier liquid in drop 66 and for the outer surface of intermediate member 68. It is also preferred that an initial area 69 produced at the time of formation of drop 66 remains substantially the same until at least a time at which drop 66 is acted upon in an Image Concentrating Process Zone, or in an Excess Liquid Removal Process Zone, or in an Image Concentration/Liquid Removal Process Zone, e.g., Process Zones 12, 13 and 20. It is further preferred that area 69 remains substantially unaltered during passage through an Image Concentrating Process Zone, an Excess Liquid Removal Process Zone, or an Image Concentration/Liquid Removal Process Zone. However, should changes of area 69 occur as a result of a free-energy-driven spreading or shrinking, it is preferred that such changes occur slowly, i.e., in a period of time long compared to the time between deposition of a primary image and formation of a liquid-depleted or "dried" image. A spreading of drop 66 is typically associated with a strong propensity of drop 66 to wet surface 67, and conversely, a balling up of drop 66 is typically associated with a non-wetting contact in area 69. Hence, it is preferred that a drop 66 neither strongly wets surface 67 nor is strongly repelled by surface 67. When drop 66 is formed from a nonaqueous ink, surface energy $\gamma^{LV}$ is typically relatively low, and intermediate member 68 may be provided with a relatively low surface energy $\gamma^{SV}$ so that balling up of drops is thereby minimized and transfer of a liquid-depleted "dried" image to a receiver is enhanced.

In certain embodiments, drop spreading in a primary image may be inhibited by providing an intermediate member with a non-smooth operational surface. A surface roughness may be defined in terms of an average spatial wavelength parallel to surface 67 and an average amplitude normal to surface 67. It is preferred to provide a surface roughness of surface 67 wherein the average spatial wavelength is smaller than the width of a pixel, and the average amplitude is of the same order of magnitude as the average spatial wavelength. The average spatial wavelength of the surface roughness of surface 67 is preferably in a range of approximately between 0.01 and 0.3 pixel widths, where one pixel width is the reciprocal of the spatial frequency of the image (e.g., a spatial frequency of 400 dpi is equivalent to a pixel width of 63.5 micrometers).

Figure 8:
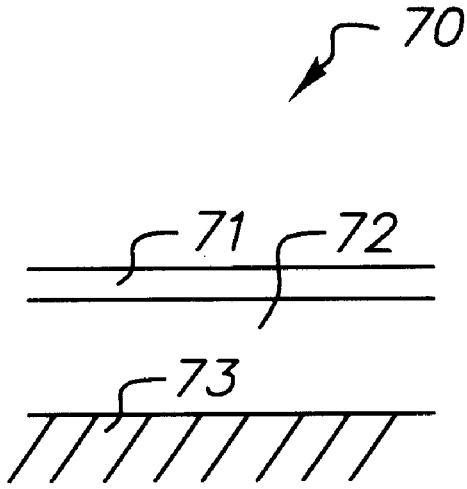
FIG. 8 schematically shows a partial cross-section of an intermediate member of the invention.

FIG. 8 schematically shows a cross-section of a portion of an intermediate member of the invention, indicated as embodiment 70, which includes a preferably compliant layer 72 formed on a support 73 and an optional thin outer layer 71 formed on layer 72. Support 73 is preferably a metallic drum, e.g., made of aluminum or any other suitable metal, which drum in certain embodiments described above is connected to ground or to a power supply when an electric field is required between the drum and an external electrode or when a corona charging device is used. In an alternative embodiment, a thin conductive electrode layer (not shown) may be provided sandwiched between layers 71 and 72 which layer in certain embodiments described above is connected to ground or connected to a suitable voltage from a power supply when an electric field is required between the drum and an external electrode or when a corona charging device is used. In another alternative structure, support 73 and a flexible layer 72 plus optional thin outer layer 71 are included in an endless web. In this alternative embodiment, a thin flexible conductive electrode layer (not shown) may be provided sandwiched between layer 72 and support 73, which support may include polymeric materials including reinforced materials, and which thin flexible conductive electrode layer in certain embodiments described above is connected to ground potential, or connected to a suitable voltage from a source of potential such as a power supply, when an electric field is required between the drum and an external electrode or when a corona charging device is used. In yet another alternative embodiment, support 73 is included in a linearly-movable platen, or adhered to a linearly-movable platen.

Layer 72 has a thickness preferably in a range of approximately between 0.5 mm and 10 mm, and more preferably, between 0.5 mm and 3 mm. In certain embodiments, layer 72 is electrically insulating. In other embodiments, layer 72 has a resistivity preferably less than approximately $10^{10}$ ohm-cm and more preferably less than $10^{7}$ ohm-cm. Layer 72 is preferably made from a group of materials including polyurethanes, fluoroelastomers, and rubbers including fluororubbers and silicone rubbers, although any other suitable material may be used. For controlling resistivity, layer 72 may include a particulate filler or may be doped with compounds such as for example antistats. In embodiments in which outer layer 71 is not included, the outer surface of layer 72 is preferred to have a suitable surface energy and roughness as described above, and the surface energy may be controlled to within a suitable range by a thin coating (not shown) of any suitable surface active material or a surfactant.

To enhance the strength of dispersion or van der Waals type attractive forces between ink particles and an intermediate member so as to help stabilize a concentrated image prior to removing any excess liquid to form a "dried" image, layer 72 preferably has a high dielectric constant. For example, a polyurethane having a dielectric constant of about 6 is particularly useful, as compared with many common polymers having a dielectric constant close to 3. Fluoropolymers are also useful in this regard. Suitable particulate fillers may be provided in layer 72 to increase the dielectric constant.

Optional layer 71 has a thickness preferably in a range of approximately between 1 micrometer and 20 micrometers. Layer 71 is preferred to be both flexible and hard, and is preferably made from a group of materials including sol-gels, ceramers, and polyurethanes. Other materials, including fluorosilicones and fluororubbers, may alternatively be used. Layer 71 preferably has a high dielectric constant and suitable particulate fillers may be provided in layer 71 to increase the dielectric constant. The outer surface of layer 71 is preferred to have a suitable surface energy and roughness, as described above, and the surface energy of this outer surface may be controlled within a suitable range by a thin coating (not shown) of any suitable surface active material or a surfactant.

In an alternative embodiment (not illustrated) of an intermediate member roller, for particular use when an electric field is applied between the rolier and an external electrode such as for example to urge migration of charged coagulates towards the operational surface of the roller, the drum support has a corrugated or textured upper surface, in contrast to a substantially non-textured upper surface shown for support 73 in FIG. 8. This corrugation or texturing has a hill-and-valley structure, with the hills and valleys deviating from a plane that is parallel with the plane of the outermost surface of the intermediate member, as described fully in the above-cited U.S. patent application Ser. No. 09/973,239, filed on Oct. 9, 2001, by Arun Chowdry et al.

For any of the thermal transfer embodiments described above in relation to FIG. 2, the materials included in the exterior of an intermediate member, e.g., members 16, 16', and 70 are selected to be resistant to thermal degradation induced by heat from the transfer operation. Moreover, for thermal transfer embodiments which include either an internal or an external heat source for the intermediate member, particulate fillers may be included in, for example, layers 71, 72 for providing an efficient transport of heat through these layers.

Figure 9:
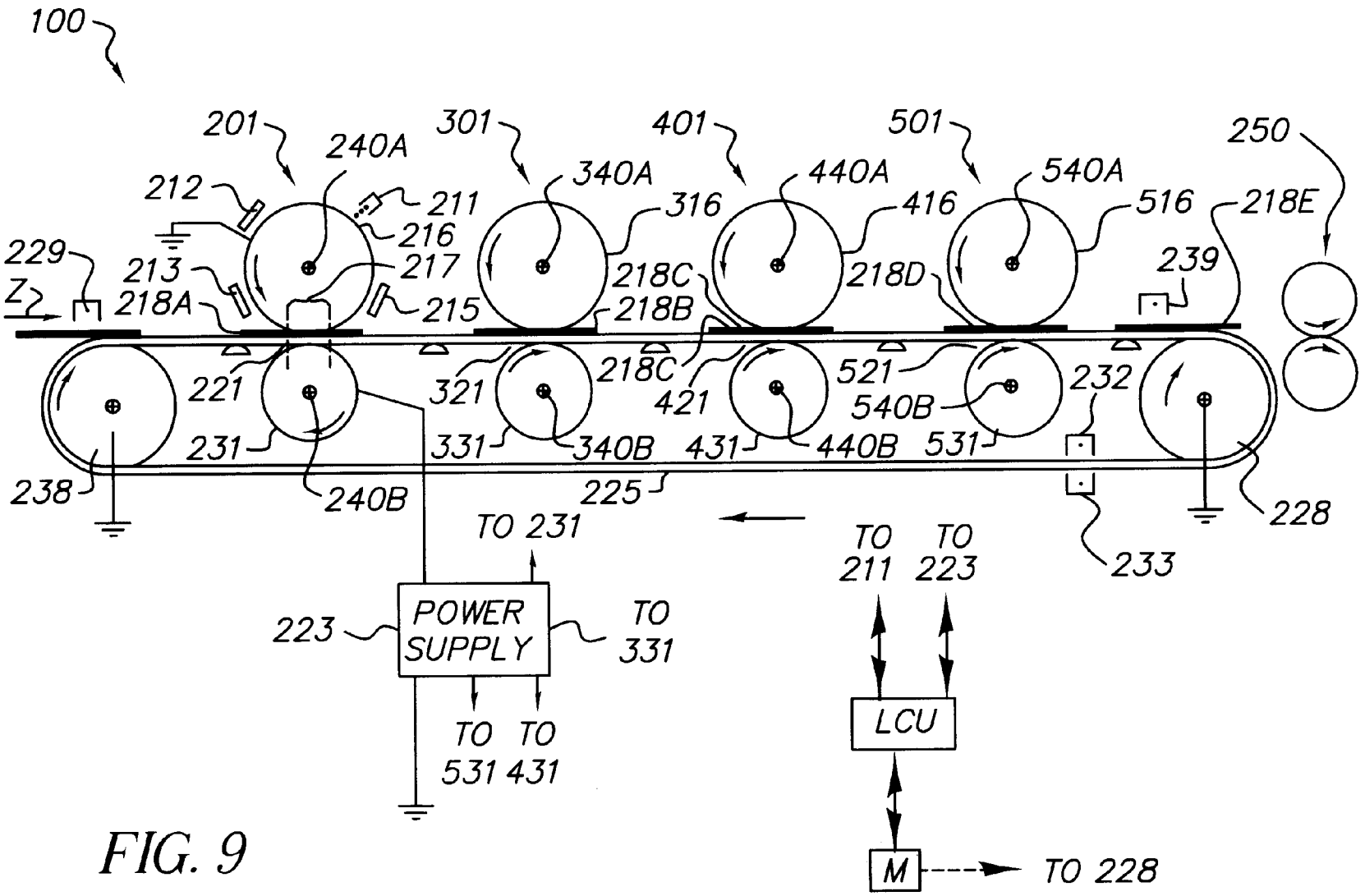
FIG. 9 is a schematic side elevational view of another embodiment of an apparatus of the invention showing both specific and generalized components thereof.

FIG. 9 shows a preferred modular color ink jet printing apparatus 100 including a plurality of modules of the type shown and described above for the embodiments of FIG. 2. Each ink jet module 201, 301, 401 and 501 produces a different color half-tone or continuous tone image and all operate simultaneously to construct a four-color ink-jet-ink-derived material image. For example, the colors in order from left to right may be black, cyan, magenta and yellow. With regard to image module 201, there are shown an ink jet device 211 and image formation zones 212 and 213 for creating an ink-jet-ink-derived image on the intermediate member (IM) 216 and a similar ink jet device and similar image formation zones are also associated with the IMs 316, 416 and 516 but not illustrated. Using any ink jet ink which is preferably an aqueous-based or nonaqueous colloidal dispersion of pigmented particles in a carrier liquid as described above, the ink jet device 211 deposits a primary ink jet image to IM 216 which is in the form of a drum or roller. The primary ink jet image on the intermediate member is rotated to a Coagulate Formation Process Zone 212 which includes any coagulate-inducing agent or mechanism as described above, wherein an aggregated image is formed from the primary ink jet image. The aggregated ink jet image on the intermediate member is then rotated to an Excess Liquid Removal Process Zone 213 which includes any excess liquid removal mechanism as described above, wherein excess liquid is removed from the concentrated image to form a liquid-depleted or "dried" ink-jet-ink-derived material image on IM 216. The liquid-depleted or "dried" image is transferred in a Transfer Process Zone 217, by any suitable transfer mechanism as described above, to a receiver sheet 218A adhered to and transported by a transport web (ITW) 225 moving through a transfer nip 221 formed by an engagement between IM 216 and a transfer backup roller (TBR) 231. Receiver sheets are fed successively in the direction of arrow Z to the surface of ITW 225 from a receiver supply unit (not shown), and the receiver sheets, e.g., 218A, are preferably adhered to ITW 225 via electrostatic hold down such as provided by a charging device 229. Other modules have respective transfer nips 321, 421, 521 between a respective intermediate member (IM) and a respective TBR. The material characteristics and dimensions of layers included in IM 216 are similar in all respects to the described material characteristics and dimensions of layers included in the similarly functional member 70 of FIG. 8, and similarly for the other modules. However, any suitable materials and dimensions may be used for IM 216. The natures of the ink jet device 211 and the ink used therein are both characterized as disclosed above, e.g., with reference to FIG. 2. Also, the Coagulate Formation Process Zone 212 and the Excess Liquid Removal Process Zone 213 are both characterized as disclosed above, i.e., they respectively include suitable agents or mechanisms as described above with reference, e.g., to FIGS. 2, 3, 4, and 5. Although not explicitly shown in FIG. 9, in alternative embodiments an Applicator Process Zone (not illustrated) is located prior to ink jet device 11, which similar in all respects to Applicator Process Zone 20 of embodiment 10' disclosed above, with further reference to FIGS. 3 and 5. After an image on IM 216 leaves Excess Liquid Removal Process Zone 213, the resulting liquid-depleted ink-jet-ink-derived material image is transferred by any suitable mechanism to a receiver sheet 218A in a Transfer Process Zone 217, including the transfer mechanisms discussed above with reference to FIG.

2. When the Transfer Process Zone 217 includes a source of heat (not illustrated) the source of heat may include an internal heater in roller 216, roller 231, or in both rollers 216 and 231. Any other suitable heat source may be used, including heat sources described above in reference to FIG. 2.

In certain embodiments, coagulates formed in Coagulate Formation Process Zone 212 are electrostatically charged, which charged coagulates are retained in the liquid-depleted or "dried" image for transfer to receiver 218A through the action of an electric field that urges the liquid-depleted image to receiver 218A. An electrical power supply 223 applies to TBR 231 a voltage, e.g. a DC electrical voltage bias of proper polarity, to attract the charged pigmented particles of the liquid-depleted image to transfer from an electrically grounded roller 216 to the receiver 218A. In certain cases, the liquid-depleted image leaving Process Zone 213 may contain insufficiently charged or uncharged coagulates, and in such cases a charging member (not illustrated) e.g., a corona charger or a roller charger may be used to deposit an image-conditioning electrostatic charge to the coagulates in the liquid-depleted image in order to make them electrostatically transferable to receiver 218A.

After transfer in Transfer Process Zone 217, the surface of the rotating intermediate member 216 is moved to a Regeneration Process Zone 215 wherein any untransferred remnants of the liquid-depleted image, which may include other debris and residual liquid, are cleaned from the surface and the surface is prepared for reuse for forming the next primary ink jet image having the particular color toner associated with this module. Any regeneration device for use in Regeneration Process Zone 215 includes devices similar to those described above with reference to FIG. 2. In this embodiment, a single transport web 225 in the form of an endless belt serially transports each of the receiver members or sheets 218A, 218B, 218C and 218D through four transfer nips 221, 321, 421 and 521 formed by the IMs 216, 316, 416 and 516, respectively of each module with respective transfer backup rollers 231, 331, 431 and 531 where each color separation image is transferred in turn to a receiver member so that each receiver member receives up to four superposed registered color images to be formed on one side thereof.

Registration of the various color images requires that a receiver member be transported through the modules in such a manner as to eliminate any propensity to wander and an ink-jet-ink-derived material image being transferred from an intermediate member in a given module must be created at a specified time. The first objective may be accomplished by electrostatic web transport whereby the receiver is held to the transport web (ITW) 225 which is a dielectric or has a layer that is a dielectric. A charger 229, such as a roller, brush or pad charger or corona charger may be used to electrostatically adhere a receiver member onto the web. The second objective of registration of the various stations' application of color images to the receiver member may be provided by various well known means such as by controlling timing of entry of the receiver member into the nip in accordance with indicia printed on the receiver member or on a transport belt wherein sensors sense the indicia and provide signals which are used to provide control of the various elements. Alternatively, control may be provided without use of indicia using a robust system for control of the speeds and/or position of the elements. Thus, suitable controls including a logic and control unit (LCU) can be provided using programmed computers and sensors including encoders which operate with same as is well known in this art.

Additionally, the objective may be accomplished by adjusting the timing of the delivery of each of the primary ink jet images; e.g. by using a fiducial mark laid down on a receiver in the first module or by sensing the position of an edge of a receiver at a known time as it is transported through a machine at a known speed. As an alternative to use of an electrostatic web transport, transport of a receiver through a set of modules can be accomplished using various other methods, including vacuum transport and friction rollers and/or grippers.

In the apparatus 100 of FIG. 9, each module 201, 301, 401 and 501 is of similar construction and as shown one transport web operates with all the modules and the receiver member is transported by the ITW 225 from module to module. Four receiver members or sheets 218A, B, C and D are shown receiving ink-jet-ink-derived material images from the different modules, it being understood as noted above that each receiver member may receive one ink-jet-ink-derived color image from each module and that up to four color images can be received by each receiver member. Each color image may be a color separation image. The movement of the receiver member with the transport belt (ITW 225) is such that each color image transferred to the receiver member at the ink-jet-ink-derived image transfer nip (221, 321, 421, 521, respectively) of each module formed with the transport belt is a transfer that is registered with the previous color transfer so that a four-color ink-jet-ink-derived material image formed in the receiver member has the colors in registered superposed relationship on the receiver member. The receiver members are then transported to a fusing station 250 as is the case for all the embodiments to fuse the ink-jet-ink-derived material images to the receiving member, e.g., using heat and pressure as necessary. A detack charger 239 or scraper may be used to overcome electrostatic attraction of the receiver member to the ITW such as receiver member 218E upon which one or more ink-jet-ink-derived material images are formed. The transport belt is reconditioned by providing charge to both surfaces by opposed corona chargers 232, 233 which neutralize charge on the surfaces of the transport belt.

The insulative transport belt or web (ITW) 225 is preferably made of a material having a bulk electrical resistivity greater than $10^5$ ohm-cm and where electrostatic hold down of the receiver member is not employed, it is more preferred to have a bulk electrical resistivity of between $10^8$ ohm-cm and $10^{11}$ ohm-cm. Where electrostatic hold down of the receiver member is employed, it is more preferred to have the endless web or belt have a bulk resistivity of greater than $1\times10^{12}$ ohm-cm. This bulk resistivity is the resistivity of at least one layer if the belt is a multilayer article. The web material may be of any of a variety of flexible materials such as a fluorinated copolymer (such as polyvinylidene fluoride), polycarbonate, polyurethane, polyethylene terephthalate, polyimides (such as Kapton®), polyethylene napthoate, or silicone rubber. Whichever material that is used, such web material may contain an additive, such as an antistatic (e.g. metal salts) or small conductive particles (e.g. carbon), to impart the desired resistivity for the web. When materials with high resistivity are used (i.e., greater than about $10^{11}$ ohm-cm), additional corona charger(s) may be needed to discharge any residual charge remaining on the web once the receiver member has been removed. The belt may have an additional conducting layer beneath the resistive layer which is electrically biased to urge charged coagulates to transfer, however, it is more preferable to have an arrangement without the conducting layer and instead apply an electrical transfer bias through either one or more of the support rollers or with a corona charger. The endless belt 225 is relatively thin (20 micrometers to 1000 micrometers, preferably, 50 micrometers to 200 micrometers) and is flexible.

In the embodiment of FIG. 9 a receiver member may be engaged at times in more than one image transfer nip and preferably is not in the fuser nip and an image transfer nip simultaneously. The path of the receiver member for serially receiving in transfer the various different color images is generally straight facilitating use with receiver members of different thickness. Support structures are provided before entrance and after exit locations of each transfer nip to engage the transport belt on the backside and alter the straight line path of the transport belt to provide for wrap of the transport belt about each respective intermediate member (IM) so that there is wrap of the transport belt of greater than 1 mm on the pre-nip side of the nip. This wrap allows for reduced pre-nip ionization. The nip is where the transfer backup or pressure roller contacts the backside of the web 225 or where no roller is used where an electrical field for electrostatic transfer of an ink-jet-ink-derived material image to a receiver sheet is substantially applied but preferably still a smaller region than the total wrap of the transport belt about the IM. The wrap of the transport belt about the IM also provides a path for the lead edge of the receiver member to follow the curvature of the IM but separate from engagement with the IM while moving along a line substantially tangential to the surface of the cylindrical IM. Preferably, the pressure of the backup rollers on the transport belt is 7 pounds per square inch or more. For electrostatic transfer, the electrical field in each nip is provided by an electrical potential provided to the IM and the backup roller. Typical examples of electrical potential might be ground potential of a conductive stripe or layer included in the intermediate member as indicated in FIG. 9, and an electrical bias of about 300 volts on the backup roller. The polarity would be appropriate for urging electrostatic transfer of the ink-jet-ink-derived material images including charged coagulates and the various electrical potentials may be different at the different modules. In lieu of a backup roller, other mechanisms may be provided for applying the electrical field for electrostatic transfer to the receiver member such as a corona charger or conductive brush or pad.

Drive to the respective modules is preferably provided from a motor M which is connected to drive roller 228, which is one of plural (two or more) rollers about which the IEW is entrained, e.g., including roller 238. The drive to roller 228 causes belt 225 to be preferably frictionally driven and the belt frictionally drives the backup rollers 231, 331, 431, 531 and also the respective IMs 216, 316, 416 and 516 in the directions indicated by the arrows so that the image bearing surfaces run synchronously for the purpose of proper registration of the various color separations that make up a completed ink-jet-ink-derived color image.

In order to overcome problems relating to overdrive or underdrive in each of the pressure nips 221, 321, 421, 521, a speed modifying device may be used, in manner as disclosed in co-pending U.S. Pat. No. 6.556,798, issued on Apr. 29, 2003, by Donald S. Rimai et al., which speed modifying device applies a speed modifying force such as for example a drag force to either or both of rollers 216 and 231, or alternatively the speed modifying device may include a redundant gearing mechanism linking rollers 216 and 231. Similarly, a speed modifying device may be used to apply a speed modifying force to either or both of the other pairs of rollers, 316 and 331, 416 and 431, 516 and 531. In alternative embodiments, in order to overcome problems relating to overdrive or underdrive in the respective nips, an engagement adjustment device may be provided, such as disclosed in copending U.S. Pat. No. 6,549,745, issued on Apr. 15, 2003, by John W. May et al., for adjusting an engagement in each of the pressure nips 221, 321, 421, 521 such that in nip 221 an engagement adjustment device moves one or both of shafts 240A and 240B keeping both shafts mutually parallel in order to control or eliminate overdrive in nip 221, and similarly for shafts 340A and 340B, 440A and 440B, 540A and 540B, respectively to adjust the engagements in the other nips 321, 421, 521, respectively.

Figure 10:
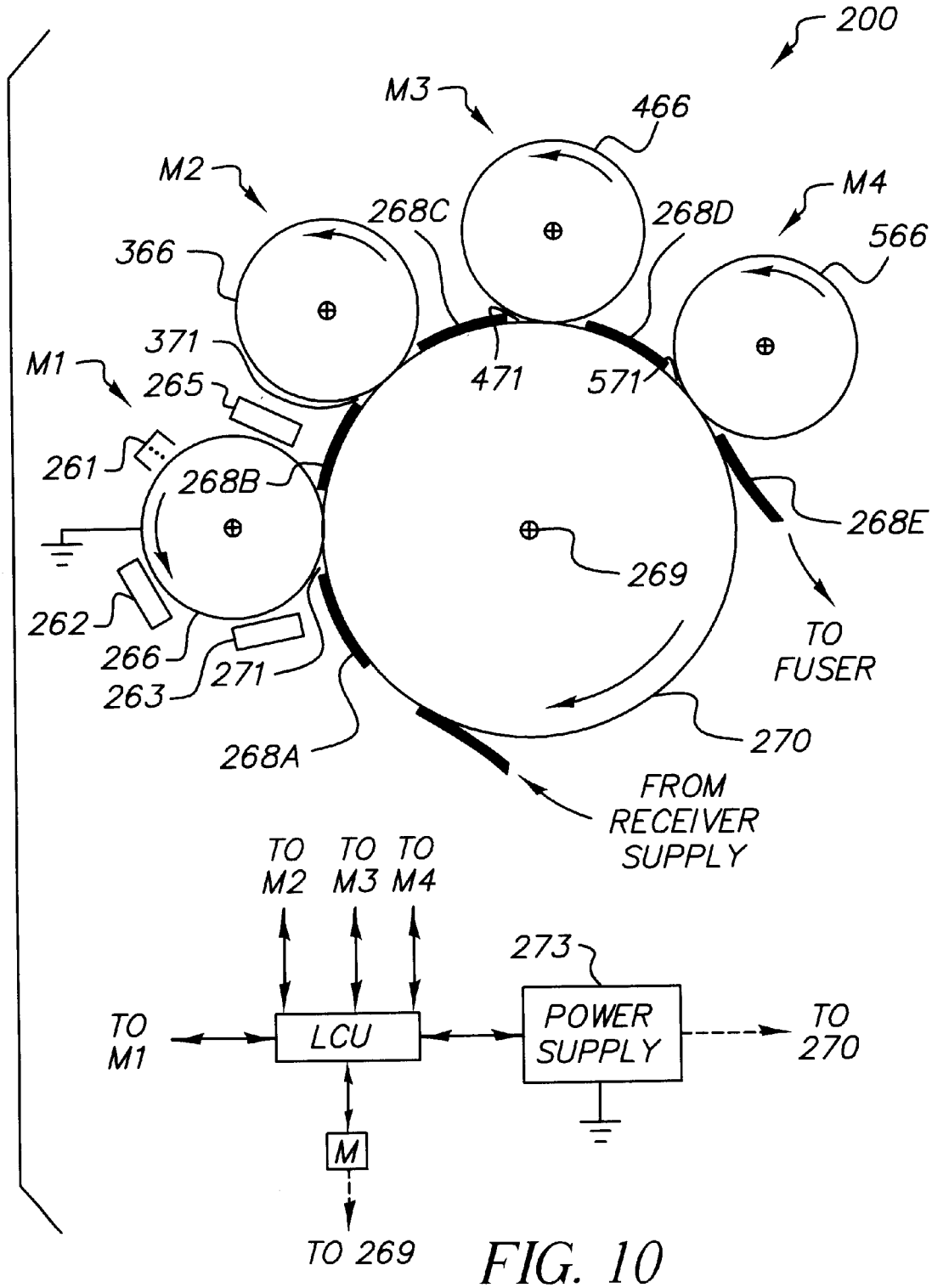
FIG. 10 is a schematic side elevational view of yet another embodiment of an apparatus of the invention showing both specific and generalized components thereof.

The invention is also applicable to an ink jet process and to other ink-jet-ink-derived material image transfer systems which employ rotatable members for transferring half-tone or continuous tone images in register to other members. The invention is also highly suited for use in other ink jet reproduction apparatus which employ rotatable members, such as, for example, those illustrated in FIGS. 10 and 11. In the apparatus 200 of FIG. 10, a plurality of color ink jet modules M1, M2, M3 and M4 are provided but situated about a large rotating receiver transporting roller 270. Roller 270 is of sufficient size to carry or support one or more, and preferably as shown, at least four receiver sheet members 268A,B,C,D on the periphery thereof so that a respective ink-jet-ink-derived material color image is transferred to each receiver member in respective nips 271, 371, 471, 571 as the receiver members each serially move from one color module to the other with rotation of roller 270. The receiver members are moved serially from a paper supply (not shown) on to the drum or roller 270 in response to suitable timing signals from a logic and control unit (LCU) as is well known. After being fed onto roller 270, the receiver member 268A may be retained on the roller by electrostatic attraction or gripper member(s). The receiver member, say 268A, then rotates past module M1 wherein an ink-jet-ink-derived material color image, i.e., a liquid-depleted or "dried" image formed on intermediate member or roller 266, is transferred from roller 266 to receiver 268A at a transfer nip 271 between roller 266 and roller 270. Following transfer, roller 266 rotates to Regeneration Process Zone 265 where the intermediate member 266 is cleaned and prepared as described previously above to receive a new primary ink jet image from device 261. Each intermediate member 266, 366, 466, 566 in this embodiment has characteristics and materials as described for the previously described embodiments herein. The ink-jet-ink-derived material color image, for example black color, is formed on intermediate member (IM) 266 in a manner as described for prior embodiments, e.g., utilizing an ink jet device 261, a Coagulate Formation Process Zone 262, and an Excess Liquid Removal Process Zone 263. Although not explicitly shown in FIG. 9, in alternative embodiments an Applicator Process Zone (not illustrated) is located prior to ink jet device 11, which similar in all respects to Applicator Process Zone 20 of embodiment 10' disclosed above, with further reference to FIGS. 3 and 5. The ink for use in device 261 is a preferably nonaqueous or aqueous-based colloidal dispersion of pigmented particles. The resulting liquid-depleted ink-jet-ink-derived material color image on roller 266, which contains coagulates derived from the dispersion, is transferred to a receiver by any suitable transfer mechanism as previously discussed in reference to FIG. 2. Drive is provided from a motor M. The other members are frictionally driven by the member receiving the motor drive through friction drive at each of the nips. Thus, if roller 270 receives the motor drive at shaft 269, each IM is driven without slip by frictional engagement at the respective transfer nip. Each nip has the members under a suitable pressure, wherein overdrive or underdrive may be controlled in a manner as for apparatus 100. For electrostatic transfer of an electrostatically charged liquid-depleted image to a receiver, an electrical bias is provided by a power supply (PS) 273 to receiver transporting roller 270 to provide suitable electrical biasing for urging electrostatic transfer of a respective ink-jet-ink-derived material color image from a preferably electrically grounded respective IM such as IMs 266, 366, 466 and 566 to a respective receiver sheet. An auxiliary charging device (not shown) may be situated between device 263 and transfer nip 271, which auxiliary charging device can be used to provide an electrostatic charge or augment any electrostatic charge of the liquid-depleted image prior to electrostatic transfer to receiver 268A. A plural ink-jet-ink-derived material color image is thereby formed on the receiver member as the receiver member moves serially past each color module to receive from the respective modules M1, M2, M3 and M4 respective color images, e.g., black, cyan, magenta and yellow images respectively, in register. After forming the plural color image on the receiver members, the receiver members, e.g., receiver 268E, are moved to a fusing station (not shown) wherein the ink-jet-ink-derived plural color images formed thereon are fixed to the receiver members. The color images described herein have the colors suitably registered on the receiver member to form full process color images similar to color photographs.

Figure 11:
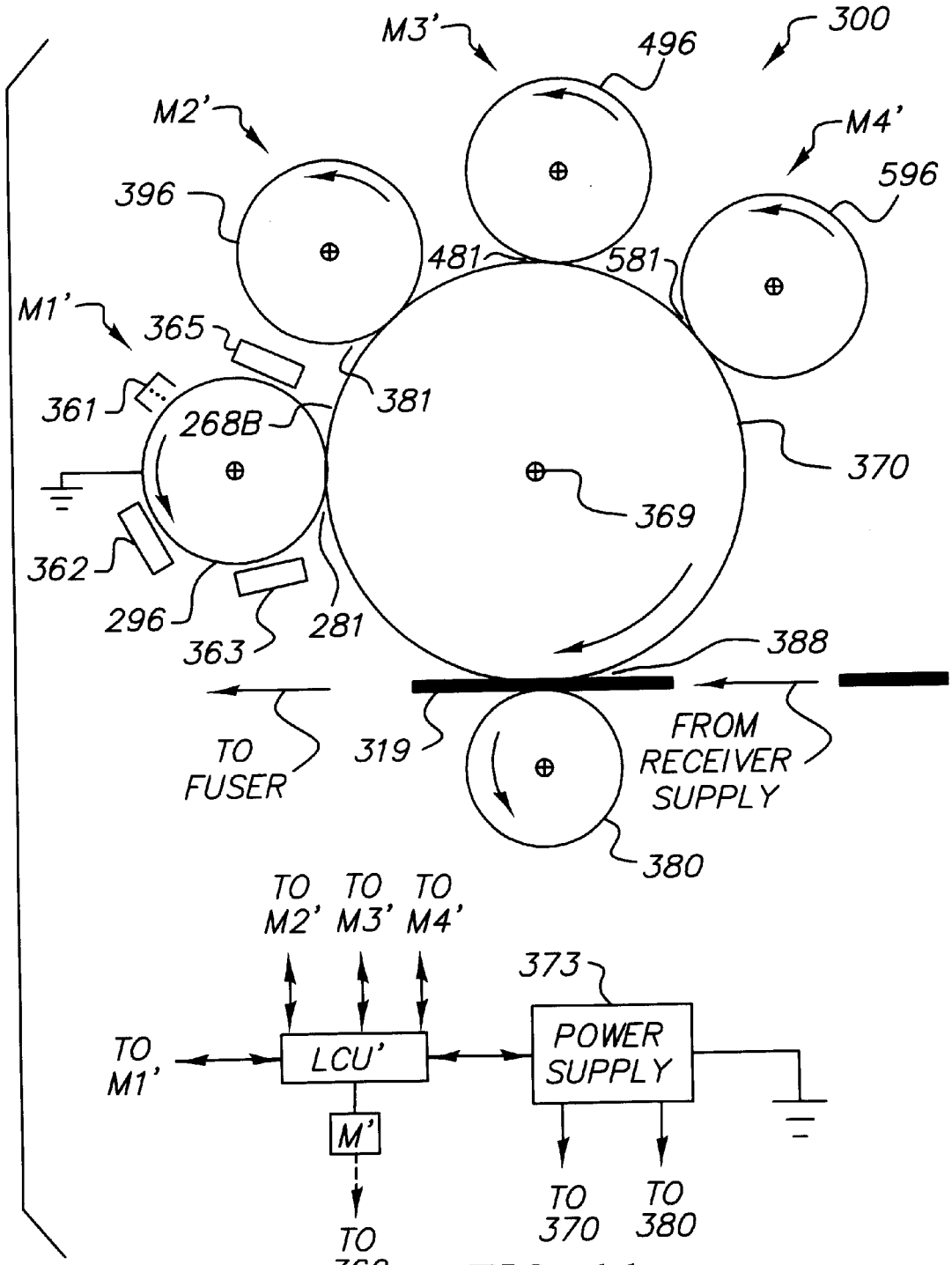
FIG. 11 is a schematic side elevational view of still yet another embodiment of an apparatus of the invention showing both specific and generalized components thereof.

In the embodiment of FIG. 11, four color modules M1', M2', M3', and M4' are shown situated about a common rotatable member or common roller 370 in the apparatus 300. Each color module is an intermediate member (IM) having zones associated therewith for forming an ink-jet-ink-derived material halftone or continuous tone color image on each corresponding IM for a respective color. Each IM 296, 396, 496, 596 forms a respective color image in a similar manner as for the IMs described above in apparatus 100 and 200, i.e, by using ink jet device 361, Coagulate Formation Process Zone 362, and Excess Liquid Removal Process Zone 363. Although not explicitly shown in FIG. 11, in alternative embodiments an Applicator Process Zone (not illustrated) is located prior to ink jet device 361, which is similar in all respects to Applicator Process Zone 20 of embodiment 10' disclosed above. In a Regeneration Process Zone 365, IM 296 is prepared for a new primary ink jet image, in manner described above. Preferably, the order of color image transfer to the common roller 370 is M1'—yellow, M2'—magenta, M3'—cyan, and M4'—black. The respective ink-jet-ink-derived material images formed on the respective intermediate rollers are each transferred, by any suitable mechanism as described above for embodiment 200, to the common roller 370 at a respective nip, e.g., nip 281, formed with the IM under pressure and with a suitable electrical biasing as needed for electrostatic transfer provided by power supply (PS') 373 to common roller 370, with roller 296 preferably grounded. Each color image is sequentially transferred in register to the outer surface of the common roller 370 to form a plural color image on the common roller. Drive from a motor drive M' is preferably provided to a shaft 369, and common roller 370 is frictionally engaged (nonslip) with each of the IMs 296, 396, 496, 596 under pressure. A receiver member 319 is fed from a suitable paper supply in timed relationship with the plural four-toner color ink-jet-ink-derived material image formed serially in registered superposed relationship on the common roller 370, the four-color image being transferred in a plural image transfer station to the receiver member at a nip 388 formed with backup roller 438. If the coagulates of each of the individual liquid-depleted images are charged, the power supply PS' 373 provides suitable electrical biasing to backup roller 380 in the plural image transfer station to induce electrostatic transfer to the receiver member of a plural or multicolor image bearing an electrostatic charge. An electrostatic charge associated with each color separation image that is transferred electrostatically to common roller 370 in nips 281, 381, 481, 581 may be inherent to the coagulates, or the electrostatic charge may otherwise be augmented or created on each liquid-depleted image by an auxiliary charging device (not illustrated) located for example between Excess Liquid Removal Process Zone 363 and transfer nip 281, and similarly for the other modules. The receiver member is then fed to a fuser member (not shown) for fixing of the four-color ink-jet-ink-derived material image thereto as necessary. A transport belt (not shown) may be used to transport the receiver member 319 through the nip 388 wherein in the nip, the receiver member is between the IM and the transport belt. Overdrive (or underdrive) corrections for transfer nips 281, 381, 481, 581 may be provided as described hereinabove for previous embodiments. A cleaning station (not illustrated) may be provided between nip 388 and module M1' for cleaning off any residual ink-jet-ink-derived material from common roller 370. In an alternative embodiment, a web (not illustrated) may be employed instead of the common roller.

In certain alternative embodiments (not illustrated) a liquid-depleted image is not formed, and an aggregated image formed in the Coagulate Formation Process Zone is transferred to a receiver in the Transfer Process Zone, i.e., no Excess Liquid Removal Zone is included in the apparatus.

Notwithstanding disclosure hereinabove relating to rotatable intermediate members, an intermediate member may in certain embodiments be a linearly-movable planar member, e.g., in the form of a plate or a platen, or, the intermediate member may mounted on a plate or a platen. In an imaging apparatus including a planar intermediate member, the planar intermediate member is moved along a linear path past various devices or process zones having characteristics similar to those described above with reference to FIGS. 2 and 3, which devices or process zones are disposed along a direction of motion of the plate or platen. Thus, in an apparatus which includes a linearly-movable planar intermediate member, the devices or process zones can be disposed sequentially in the following order: an ink jet device; a Coagulate Formation Process Zone; an Excess Liquid Removal Process Zone; a Transfer Process Zone; and, a Regeneration Process Zone, wherein the ink jet device is located near a starting position for ultimately forming an image on a receiver provided in the Transfer Process Zone, and the Regeneration Process Zone is located after the Transfer Process Zone near an ending position along the direction of motion. Alternatively, the Regeneration Process Zone may be located near a starting position and the Transfer Process Zone located near the ending position. After the platen reaches the ending position, the direction of the platen is reversed and the platen is moved back to the starting position. In alternative embodiments, an Applicator Process Zone is located between the Regeneration Process Zone and the ink jet device, which Applicator Process Zone is similar to that described above with reference to FIG. 3.

In embodiments above including embodiments 100, 200 and 300, any known non-electrostatic transfer process may be used as described previously above, including thermal transfer, pressure transfer and transfusing, whereupon devices such as power supplies, corona chargers and so forth such as may be used for providing a transfer electric field are not required. Furthermore, in alternative embodiments, any combination of thermal transfer, pressure transfer, or transfusing with electrostatic transfer may be used. It is to be understood that suitable modifications are to be made to the relevant materials and apparatus to enable any of these embodiments or alternative embodiments, and that any suitable particulate ink jet ink may be used, including aqueous-based or nonaqueous particulate dispersions containing charged particles, uncharged particles, electrostatically stabilized particles, or sterically stabilized particles.

The subject invention has a number of advantages over prior art. In the present invention, a nonaqueous ink jet ink may be used which can be similar to a relatively costly liquid developer employed in electrostatographic imaging technology, yet a much smaller volume of ink is advantageously used. In addition, use of such a nonaqueous ink in the present invention provides a much simpler imaging process than liquid developer electrophotography, inasmuch as there is neither expensive photoconductor nor charging thereof required. Also, in all embodiments excepting that of apparatus 300, only one transfer is required for each ink-jet-ink-derived color of a color image, unlike two transfers per color toner image such as required in an electrophotographic engine which includes an intermediate member. By comparison with a conventional intermediate transfer member such as is typically used for electrostatic transfer in electrophotography, an intermediate member of the present invention may in certain embodiments be designed for thermal or pressure transfer, which intermediate member can be less expensive and the transfer mechanism simpler and cheaper than for electrostatic transfer. Unlike liquid developer electrophotography, an ink for use in the present invention may be aqueous-based, thereby advantageously allowing the use of presently available, aqueous-based, pigmented particulate ink jet inks, or similar inks. An aqueous-based ink for use in the present invention also has advantages over a liquid developer, i.e., low toxicity and nonflammability.

In common with certain recent ink jet technology which utilizes an intermediate member, an image receiver of the subject invention is decoupled from the ink jet device, so that a much larger variety of receivers may be used, including rough receivers, smooth receivers, porous receivers and non-porous receivers. Not only can a wide variety of receivers be used, but also image spreading can be better controlled by controlling the surface characteristics of the intermediate member as well as independently controlling the ink surface tension.

A key attribute which advantageously differentiates the subject invention from conventional ink jet technology is the ability to remove excess liquid from a primary image, thereby forming on an intermediate member a dry (or relatively dry) ink-jet-ink-derived material image for transfer to a receiver. This gives important additional advantages, including: enhanced image sharpness and less image bleeding on a receiver as compared with conventional ink jet imaging; no drying step for an image on a receiver, which drying is cumbersome and costly, especially for aqueous-based inks owing to the large latent heat of vaporization of water, and which drying may cause a receiver to curl or otherwise distort; and, an ability to recycle any removed excess liquid from a primary image, not possible with conventional ink jet imaging.

Another very important attribute, which advantageously differentiates the subject invention from known ink jet technology, is an ability to use a wide variety of inks which are coagulable on an intermediate member by known mechanisms or agents. The coagulable inks include single-phase inks, colloidal inks, nonaqueous inks, and aqueous-based inks. Moreover, the coagulable inks include solutions containing colorants or precursors of colorants, which single-phase solutions advantageously have a negligible propensity to clog ink jet nozzles.

The invention has been described in detail with particular reference to certain preferred embodiments thereof, but it will be understood that variations and modifications can be effected within the spirit and scope of the invention.

What is claimed is:

1. For forming an ink-jet-ink-derived material image on an operational surface of a member and transferring said ink-jet-ink-derived material image to a receiver member, an imaging apparatus comprising:

an ink jet device for imagewise jetting droplets of a coagulable liquid ink on to said operational surface, said ink jet device thereby forming a primary image on said operational surface of said member;

a plurality of process zones associated with said operational surface of said member, said plurality of process zones located sequentially in proximity with said operational surface, and said plurality of process zones including a coagulate formation process zone, an excess liquid removal process zone, and a transfer process zone;

at least one of an agent and a mechanism for causing a formation of coagulates within a liquid phase of said primary image, so as to form on said operational surface an aggregated image from said primary image in said coagulate formation process zone;

a liquid-removal mechanism for removing from said coagulates a portion of said liquid phase of said aggregated image so as to form on said operational surface a liquid-depleted image in said excess liquid removal process zone; and a transfer mechanism for transferring, to a receiver member from said operational surface, said liquid-depleted image in said transfer process zone; and wherein said primary image includes a plurality of smallest resolved imaging areas and each of said plurality of smallest resolved imaging areas receives from said ink jet device a preselected number of droplets of said coagulable liquid ink, said preselected number including zero.

2. The apparatus according to claim 1, further comprising:

a regeneration process zone included in said plurality of process zones, said regeneration process zone associated in proximity with said operational surface of said intermediate member at a location between said transfer zone and said ink jet device; and wherein said regeneration process zone is provided a mechanism for regenerating said operational surface, said regenerating preceding a subsequent formation by said ink jet device of a new primary image.

3. The apparatus according to claim 2, further comprising:

an applicator process zone included in said plurality of process zones, said applicator process zone associated in proximity with said operational surface of said intermediate member at a location between said regeneration process zone and said transfer zone;

wherein said applicator process zone is provided a mechanism for applying a coagulate-inducing material to said operational surface after said regenerating.

4. The apparatus according to claim 1 wherein said member is a rotatable intermediate member.

5. The apparatus according to claim 1 wherein said member is a linearly-movable intermediate member.

6. The apparatus according to claim 1 wherein said ink jet device forms, on said operational surface of said member, a half-tone primary image.

7. The apparatus according to claim 1 wherein said ink jet device forms, on said operational surface of said member, a continuous tone primary image.

8. For forming an ink-jet-ink-derived material image on an operational surface of a member and transferring said ink-jet-ink-derived material image to a receiver member, an imaging apparatus comprising:

an ink jet device for imagewise jetting, on to said operational surface, droplets of a coagulable liquid ink, said ink jet device thereby forming a primary image on said operational surface of said intermediate member;

a plurality of process zones associated with said operational surface of said intermediate member, said plurality of process zones located sequentially in proximity with said operational surface and said plurality of process zones including a coagulate formation process zone and a transfer process zone;

at least one of an agent and a mechanism for causing a formation of coagulates within said primary image, so as to form on said operational surface an aggregated image from said primary image in said coagulate formation process zone;

a mechanism for transferring in said transfer process zone said aggregated image to a receiver member from said operational surface, and wherein said primary image includes a plurality of smallest resolved imaging areas and each of said plurality of smallest resolved imaging areas receives from said ink jet device a preselected number of droplets of said coagulable liquid ink, said preselected number including zero.

9. The apparatus according to claim 8, further comprising:

a regeneration process zone included in said plurality of process zones, said regeneration process zone associated in proximity with said operational surface of said intermediate member at a location between said transfer zone and said ink jet device; and wherein said regeneration process zone is provided a mechanism for forming a regenerated operational surface for a subsequent formation thereon, by said ink jet device, of a new primary image.

10. The apparatus according to claim 9, further comprising:

an applicator process zone included in said plurality of process zones, said applicator process zone associated in proximity with said operational surface of said intermediate member at a location between said regeneration process zone and said transfer zone; and wherein said applicator process zone is provided a mechanism for applying a coagulate-inducing material to said regenerated operational surface.

11. The apparatus according to claim 8 wherein said coagulable liquid ink is a colloidal dispersion of particles in a carrier liquid and wherein said primary image includes said particles and said carrier fluid.

12. The apparatus according to claim 11 wherein said particles are pigmented particles comprising a finely comminuted pigment dispersed in a binder.

13. The apparatus according to claim 11, said coagulable liquid ink being an electrostatically stabilized colloid, wherein, in said coagulate formation process zone, said at least one of an agent and a mechanism for causing a formation of coagulates includes an external salt donation mechanism, said salt donation mechanism for introducing a multivalent salt solution into said primary image, said external salt donation mechanism including:

a sponge wettable with said salt solution, which sponge for delivering at least a critical amount of said salt solution contacts said primary image on said intermediate member, said sponge included in the group consisting of a web, a squeegee blade, and a roller;

a spray device for delivering at least a critical amount of an aerosol of said salt solution to said primary image on said intermediate member;

a secondary ink jet device for depositing on each imaging pixel included in said primary image at least a minimum critical amount of said salt solution for inducing said formation of coagulates, which minimum critical amount is proportional to a quantity of said ink previously deposited on the same pixel of said primary image;

wherein said multivalent salt solution includes at least one of a multivalent cation and a multivalent anion; and wherein, upon an admixture in said coagulate formation process zone of any delivered critical amount or more of said salt solution with any of said ink of said primary image, an aggregated image is formed.

14. The apparatus according to claim 11, said colloidal dispersion of particles being electrostatically stabilized, wherein, in said coagulate formation process zone, said at least one of an agent and a mechanism for causing a formation of coagulates comprises: a device for introducing a solution of a pH-altering agent into said primary image thereby altering the ph of said liquid phase, said altering substantially producing a point of zero charge corresponding to a critical ph for said formation of coagulates, wherein said device for introducing a pH-altering agent includes:

a sponge wettable with said solution of said pH-altering agent, which sponge for delivering at least a critical amount of said pH-altering agent contacts said primary image on said intermediate member, said sponge included in the group consisting of a web, a squeegee blade, and a roller;

a spray device for delivering at least a critical amount of an aerosol of said solution of said pH-altering agent on to said primary image on said intermediate member;

a secondary ink jet device for depositing on each imaging pixel included in said primary image at least a minimum critical amount of said solution of said pH-altering agent for inducing said formation of coagulates, which minimum critical amount is proportional to a quantity of said ink previously deposited on the same pixel of said primary image; and wherein, upon an admixture in said coagulate formation process zone of any delivered critical amount or more of said solution of said pH-altering agent with any of said ink of said primary image, an aggregated image is formed.

15. The apparatus according to claim 11, said colloidal dispersion of particles being sterically stabilized, wherein, in said coagulate formation process zone, said at least one of an agent and a mechanism for causing a formation of coagulates comprises: a device for introducing into said primary image a non-solvent for polymeric moieties adsorbed to said sterically stabilized colloid, wherein said non-solvent is miscible with said liquid phase such that any combined fluid containing both said liquid phase and any said non-solvent is also a non-solvent for said polymeric moieties, said device for introducing into said primary image a non-solvent including:

a sponge wettable with said non-solvent, which sponge for delivering at least a critical amount of said non-solvent contacts said primary image on said intermediate member, said sponge included in one of a group consisting of a web, a squeegee blade, and a roller;

a spray device for delivering at least a critical amount of an aerosol of said non-solvent to said primary image on said intermediate member;

a secondary ink jet device for depositing on each imaging pixel included in said primary image at least a minimum critical amount of said non-solvent for inducing said formation of coagulates, which minimum critical amount is proportional to a quantity of said ink previously deposited on the same pixel of said primary image; and wherein, upon an admixture in said coagulate formation process zone of any delivered critical amount or more of said non-solvent with any of said ink of said primary image, an aggregated image is formed.

16. The apparatus according to claim 11 wherein said colloidal dispersion of particles being sterically stabilized, and wherein, in said coagulate formation process zone, said at least one of an agent and a mechanism for causing a formation of coagulates comprises: an agent for causing at least a partial denuding of said sterically stabilized colloidal particles, said at least partial denuding including at least one of the mechanisms selected from the following group:

at least a partial removal of polymeric moieties adsorbed to said sterically stabilized colloidal particles;

at least a partial debonding of said polymeric moieties;

at least a partial desorption of said polymeric moieties; and at least a partial destruction of said polymeric moieties; and wherein said agent for causing at least a partial denuding includes a source of radiation directed towards said primary image on said intermediate member, which radiation may cause at least one of the following effects for producing at least a partial denuding of said particles:

a heating of one or more components of said primary image;

a photochemical reaction for photochemically cleaving said polymeric moieties from said particles; and a photochemical reaction for photochemically destroying said polymeric moieties.

17. The apparatus according to claim 11 wherein, in said Coagulate formation process zone, said at least one of an agent and a mechanism for causing a formation of coagulates comprises a heating mechanism, said heating mechanism for producing an aggregated image by a heating, said heating mechanism including at least one of: the group consisting of a source of radiant energy directed towards said primary image;

a source of heat located internally within said intermediate member;

an external, heated, member separated by a small gap from said primary image;

an external, heated, member contacting said primary image; and wherein prior to said heating said colloidal dispersion of particles is stabilized by an enthalpic stabilization.

18. The apparatus according to claim 11 wherein, in said coagulate formation process zone, said at least one of an agent and a mechanism for causing a formation of coagulates within a liquid phase of said primary image, said at least one of an agent and a mechanism comprising a cooling mechanism, said cooling mechanism for producing an aggregated image by a cooling, said cooling mechanism including at least one of the group consisting of:

a peltier effect cooling device located internally within said intermediate member;

a coolant circulated in conduits located internally within said intermediate member;

an external, cooled, member separated by a small gap from said primary image; and an external, cooled, member contacting said primary image; and wherein prior to said cooling said colloidal dispersion of particles is stabilized by an entropic stabilization.

19. The apparatus according to claim 11 wherein said colloidal dispersion of particles in said primary image including a first plurality of charged particles dispersed in said liquid phase, and wherein, in said coagulate formation process zone, said at least one of an agent and a mechanism for causing a formation of coagulates comprises: a hetero-colloid donation mechanism, said hetero-colloid donation mechanism for addition of a hetero-colloid, said hetero-colloid including a second plurality of charged particles dispersed in a secondary carrier fluid, said charged particles having a polarity opposite to a polarity of said particles of said colloidal dispersion of particles, said hetero-colloid donation mechanism including:

a sponge wettable with said hetero-colloid, which sponge for delivering at least a critical amount of said hetero-colloid contacts said primary image on said intermediate member, said sponge included in one of the group consisting of a web, a squeegee blade, and a roller;

a spray device for delivering at least a critical amount of an aerosol of said hetero-colloid to said primary image on said intermediate member;

a secondary ink jet device for depositing on each imaging pixel included in said primary image at least a minimum critical amount of said solution of said hetero-colloid for inducing said formation of coagulates, which minimum critical amount is proportional to a quantity of said ink previously deposited on the same pixel of said primary image;

wherein said liquid phase and said secondary carrier fluid are mutually miscible; and wherein, upon an admixture in said coagulate formation process zone of any delivered critical amount or more of said hetero-colloid with any of said ink of said primary image, a hetero-coagulate aggregated image is formed by mutual attraction of said first plurality of charged particles and said second plurality of charged particles.

20. The apparatus according to claim 8 wherein, in said coagulate formation process zone, at least one of an agent and a mechanism for causing a formation of coagulates comprises:

an electrocoagulation member disposed in proximity to and facing said intermediate member, said electrocoagulation member including an electrode having a layer covering said electrode, said electrocoagulation member separated by a gap from said operational surface of said intermediate member, said electrode connected to a source of both voltage and current;

a sub-surface electrode included in said intermediate member, said sub-surface electrode having a polarity positive with respect to said electrode of said electrocoagulation member, said sub-surface electrode preferably grounded, said sub-surface electrode covered by a compliant layer;

wherein said coagulable liquid ink is an electrocoagulable ink; and wherein a passage of electrical current through said electrocoagulable ink included in said primary image on said operational surface causes a spontaneous formation of a coagulated layer directly contacting said operational surface, thereby resulting in an aggregated image.

21. The apparatus according to claim 20 wherein a size of said gap is in a range of approximately between 5 micrometers and 100 micrometers, each of said covering layer and said compliant layer having a resistivity of less than about $10^4$ ohm-cm.

22. The apparatus according to claim 11 wherein said at least one of an agent and a mechanism for causing a formation of coagulates comprises an polymer-solution-donation mechanism, said polymer-solution-donation mechanism for introducing a fluid containing a polymeric material dispersed as a colloid in said fluid, which polymeric material is not adsorbed by said particles of said colloidal dispersion, said fluid miscible with said liquid phase of said primary image, said polymer-solution-donation mechanism including one selected from the group consisting of the following:

a sponge wettable with said fluid containing a polymeric material, which sponge for delivering at least a critical amount of said fluid containing a polymeric material contacts said primary image on said intermediate member, said sponge included in one of the group of a web, a squeegee blade, and a roller;

a spray device for delivering at least a critical amount of an aerosol of said fluid containing a polymeric material to said primary image on said intermediate member;

a secondary ink jet device for depositing on each imaging pixel included in said primary image at least a minimum critical amount of said fluid containing a polymeric material for inducing said formation of coagulates, which minimum critical amount is proportional to a quantity of said ink previously deposited on the same pixel of said primary image; and wherein, upon an admixture in said coagulate formation process zone of any delivered critical amount or more of said fluid containing a polymeric material with any of said ink of said primary image, an aggregated image is formed by a depletion flocculation.

23. The apparatus according to claim 9 wherein said coagulable liquid ink is a colloidal dispersion of particles in a carrier liquid and wherein said primary image includes said particles and said carrier fluid.

24. The apparatus according to claim 23, wherein said mechanism for applying a coagulate-inducing material to said operational surface after said regenerating comprises a pre-coat application mechanism for applying, in said applicator process zone, a pre-coat to said regenerated surface, said pre-coat application mechanism including at least one selected from the group consisting of:

a metering device;

a doctor blade;

a brush;

a sponge;

a sprayer;

a supplementary ink jet type of device in which a liquid pre-coat is selectively applied in differing amounts at different locations on said operational surface; and a smoothing device including a skive and a blade for smoothing said pre-coat.

25. The apparatus according to claim 24 wherein said pre-coat including a solution, a paste, a slurry, and a powder, and wherein said pre-coat comprising a multivalent salt, said multivalent salt including at least one of a multivalent cation and a multivalent anion, wherein any component included in any of said solution, said paste, said slurry and said powder is soluble in said carrier liquid of said ink included in said primary image, and wherein said multivalent salt causes a formation of coagulates within said primary image.

26. The apparatus according to claim 24 wherein said pre-coat comprising a pH-altering agent, said pre-coat including a solution, a paste, a slurry, and a powder including said pH-altering agent, said pH-altering agent including one of an acid and a base, any component included in any of said solution, paste, slurry and powder being soluble in said carrier liquid of said ink in said primary image, wherein said pH-altering agent causes a formation of coagulates within said primary image.

27. The apparatus according to claim 24 wherein said pre-coat comprising a non-solvent for polymeric moieties adsorbed to said particles, and wherein said colloidal dispersion being sterically stabilized, said non-solvent being miscible with said carrier liquid of said ink in said primary image such that any combined fluid containing both said carrier liquid of said ink and any said non-solvent is also a non-solvent for said polymeric moieties, wherein said non-solvent causes a formation of coagulates within said primary image.

28. The apparatus according to claim 24 wherein said pre-coat comprising a hetero-colloid, and wherein said colloidal dispersion of particles in said primary image including a first plurality of charged particles dispersed in said carrier liquid of said ink, said hetero-colloid including a second plurality of charged particles dispersed in a secondary carrier fluid, said second plurality of charged particles having a polarity opposite to a polarity of said particles of said colloidal dispersion of particles of said ink, said carrier liquid of said ink and said secondary carrier fluid being mutually miscible, wherein said hetero-colloid causes a hetero-coagulation of said first plurality of charged particles and said second plurality of charged particles within said primary image.

29. The apparatus according to claim 24 wherein said pre-coat comprising a fluid containing a polymeric material dispersed as a colloid in said fluid, which polymeric material is not adsorbed by said particles of said colloidal dispersion, said fluid miscible with said carrier liquid of said ink in said primary image, and wherein said polymeric material causes a depletion flocculation of said colloidal dispersion in said primary image.

30. The apparatus according to claim 23 wherein said carrier fluid included in a colloidal dispersion of particles is nonaqueous.

31. The apparatus according to claim 30 wherein said carrier fluid has a flash point equal to or greater than about 140° F.

32. The apparatus of claim 23 wherein said carrier fluid included in a colloidal dispersion of particles is aqueous-based.

33. The apparatus of claim 23 wherein said colloidal dispersion of particles is characterized by at least one of a steric stabilization and an electrostatic stabilization.

34. The apparatus of claim 8 wherein said intermediate member comprises:

a support;

a compliant layer formed on said support; and wherein said support includes one of the group consisting of a drum, a web, and a planar linearly-movable member.

35. The apparatus of claim 8 wherein said intermediate member comprises an electrode biasable by a source of potential including ground potential.

36. The apparatus of claim 33 wherein said compliant layer of said intermediate member has a thickness in a range of approximately between 0.5 mm and 10 mm.

37. The apparatus of claim 36 wherein said compliant layer of said intermediate member has a thickness in a range of approximately between 0.5 mm and 3 mm.

38. The apparatus of claim 34 wherein a thin outer layer of said intermediate member is formed on said compliant layer of said intermediate member.

39. The apparatus of claim 38 wherein said thin outer layer of said intermediate member has a thickness in a range of approximately between 1 micrometer and 20 micrometers.

40. The apparatus of claim 38 wherein said thin outer layer of said intermediate member is made from a group of materials consisting of sol-gels, ceramers, and polyurethanes.

41. The apparatus of claim 8 wherein said coagulable liquid ink and said operational surface of a member included in a primary image on said intermediate member, form a mutual interface for which interface a value of spreading coefficient does not exceed substantially zero.

42. The apparatus of claim 1 wherein said liquid-removal mechanism includes at least one of the group of:

a squeegee roller;

a squeegee blade;

an evaporation mechanism;

a blotting mechanism;

a vacuum mechanism;

a skiving mechanism; and an air knife mechanism.

43. The apparatus according to claim 42, wherein said liquid-removal mechanism further includes an electrode biased by a source of voltage, which voltage has a polarity the same as a polarity of said particles included in said aggregated image.

44. The apparatus according to claim 42, wherein said evaporation mechanism including at least one of the group of:

a source of heat internal to said intermediate member;

a source of heat located in a contacting external member;

a source of radiation absorbable by any component of said aggregated image; and an airflow.

45. The apparatus according to claim 42 wherein said blotting mechanism comprises:

an auxiliary rotatable member, said auxiliary rotatable member including a conformable, absorbent, blotting layer for contacting and simultaneously blotting said aggregated image; and wherein during blotting, substantially all of said coagulates remain on said operational surface of said intermediate member.

46. The apparatus according to claim 42 wherein said intermediate member includes a roller having an adsorbent layer thereon, and wherein said vacuum mechanism comprises:

an intermittent source of vacuum which draws said liquid phase of said aggregated image through said absorbent layer into an interior chamber of said intermediate member roller;

a vent connected to said interior chamber of said intermediate member roller;

wherein substantially all of said coagulates remain on said operational surface of said intermediate member roller; and wherein said source of vacuum further draws said liquid phase through said vent so as to remove said liquid phase from said interior chamber of said intermediate member roller.

47. The apparatus according to claim 42 wherein said intermediate member includes an external auxiliary roller defining an interior chamber and having an absorbent layer, and wherein said vacuum mechanism comprises:

a source of vacuum which draws said liquid phase of said aggregated image through said absorbent layer into said interior chamber of said auxiliary roller;

a vent connected to said interior chamber of said auxiliary roller;

wherein substantially all of said coagulates remain on said operational surface of said intermediate member; and wherein said source of vacuum further draws said liquid phase through said vent so as to remove said liquid phase from said interior chamber of said auxiliary roller.

48. The apparatus according to claim 8 wherein said transfer mechanism includes at least one of an electrostatic transfer mechanism, a thermal transfer mechanism, and a pressure transfer mechanism.

49. The apparatus according to claim 48 wherein in said electrostatic transfer mechanism a charging device is used for applying an electrostatic charge to an ink-jet-ink-derived material included in a liquid-depleted image formed in the excess liquid removal process zone.

50. The apparatus according to claim 9 wherein said regeneration process zone includes a mechanism for regenerating said operational surface which mechanism for regenerating said operational surface substantially removes, from said operational surface, residual material not transferred in the transfer process zone said mechanism comprising at least one of a group of devices consisting of a cleaning blade, a squeegee, a scraper for scraping said operational surface, a cleaning roller to which said residual material adheres, a cleaning brush, a solvent applicator, and a wiper.

51. In a digital imaging apparatus having a tandemly arranged plurality of image forming modules, wherein a plurality of ink-jet-ink-derived images are sequentially made in said plurality of image forming modules for successive transfers in register to a receiver member so as to form a completed plural image on said receiver member, and wherein each image forming module includes an intermediate member on which an ink-jet-ink-derived image is formed on an operational surface, a method of making said completed plural image comprising the steps of:

forming a primary image on said operational surfaces of said intermediate member by depositing droplets of a coagulable ink from an ink jet device;

producing from said primary image an aggregated image by causing a formation of a plurality of coagulates in a liquid phase;

removing a portion of said liquid phase from said aggregated images to form liquid-depleted images;

transferring said liquid-depleted images to said receiver member, said transferring done sequentially in register atop any previously transferred liquid-depleted images;

in a last module of said plurality of image forming modules, transferring a last liquid-depleted image so as to form on said receiver member said completed plural image; and prior to each cycle of forming primary images, regenerating said operational surfaces to prepare each said operational surface for receiving a new primary image from said ink jet device.

52. The method according to claim 51, wherein after said step of regenerating said operational surface and prior to said step of forming a primary image, an additional step of:

applying a coagulate-inducing material to said operational surface of said intermediate members.

53. In a digital color imaging apparatus having a plurality of tandemly arranged image forming modules, wherein a plurality of ink-jet-ink-derived images are successively transferred in register to a receiver member, each module including a intermediate member for an ink-jet-ink-derived image to be formed thereon, a method of making a full color ink-jet-ink-derived image comprising the steps of:

moving said receiver through said plurality of tandemly arranged image forming modules;

in a respective module, using an ink jet device to form an ink image made of a coagulable ink providing a color on an operational surface of an intermediate member;

forming coagulates in said ink images;

removing a portion of excess liquid from said coagulates so as to form a ink-jet-ink-derived image having said color;

transferring said ink-jet-ink-derived particulate images from said operational surfaces to said receiver member, said transfer being in register with ink-jet-ink-derived images having another color previously transferred in register to said receiver member; and moving said receiver member through remaining of said plurality of sequentially arranged image forming modules so as to form, in a last module, said full color ink-jet-ink-derived image on said receiver member.

54. The method according to claim 53, wherein each of said operational surfaces of said intermediate members, employed in the step of using an ink jet device, has a coating of a coagulate-inducing material.

55. A method of making an ink-jet-ink-derived image comprising the steps of:

using an ink jet device to form a coagulable liquid ink image on an operational surface of an intermediate member;

causing formation of coagulates in said coagulable liquid ink image;

removing an excess liquid from said coagulates in said coagulable liquid ink image so as to form an ink-jet-ink-derived material image;

in a transfer step, transferring said ink-jet-ink-derived material image from said operational surface to another member.

* * * * *